US011413876B2

(12) United States Patent
Tanaka

(10) Patent No.: US 11,413,876 B2
(45) Date of Patent: Aug. 16, 2022

(54) IMAGE RECORDING APPARATUS, COMMUNICATION SYSTEM, AND COMPUTER-READABLE MEDIUM FOR PERMITTING ANOTHER APPARATUS TO TEMPORARILY USE A CARTRIDGE FOR THE IMAGE RECORDING APPARATUS

(71) Applicant: BROTHER KOGYO KABUSHIKI KAISHA, Nagoya (JP)

(72) Inventor: Nobumasa Tanaka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/831,948

(22) Filed: Mar. 27, 2020

(65) Prior Publication Data

US 2020/0361216 A1 Nov. 19, 2020

(30) Foreign Application Priority Data

May 16, 2019 (JP) ..... JP2019-092549

(51) Int. Cl.
*B41J 2/175* (2006.01)

(52) U.S. Cl.
CPC ..... *B41J 2/17546* (2013.01)

(58) Field of Classification Search
CPC ..... B41J 2/17546; B41J 2/17543; G03G 15/5091
See application file for complete search history.

(56) References Cited

U.S. PATENT DOCUMENTS

2006/0045595 A1* 3/2006 Hanaoka ..... B41J 29/393 400/62
2006/0291890 A1* 12/2006 Park ..... G03G 15/234 399/82
2018/0173543 A1* 6/2018 Ukegawa ..... B41J 29/00

FOREIGN PATENT DOCUMENTS

JP 2004-90517 A 3/2004

* cited by examiner

*Primary Examiner* — Jason S Uhlenhake
(74) *Attorney, Agent, or Firm* — Merchant & Gould P.C.

(57) ABSTRACT

An image recording apparatus includes a controller configured to perform at least one of storing apparatus identification information stored in a memory into a cartridge memory via a cartridge interface and storing cartridge identification information stored in the cartridge memory into the memory via the cartridge interface, receive permission application information from another apparatus via a communication interface, determine whether or not reception identification information included in the received permission application information is identical to the apparatus identification information or the cartridge identification information stored in the memory, and transmit permission information representing that the said another apparatus is permitted to perform printing, to the said another apparatus via the communication interface, when determining that the cartridge has been removed from the attachment case and that the reception identification information is identical to the apparatus identification information or the cartridge identification information.

19 Claims, 15 Drawing Sheets

1st PERMISSION CONFIRMATION SCREEN

2nd PERMISSION CONFIRMATION SCREEN

3rd PERMISSION CONFIRMATION SCREEN

PERMISSION SCREEN

1st NON-PERMISSION SCREEN

2nd NON-PERMISSION SCREEN

MANAGEMENT DATABASE

| Identification Information | | Remaining Ink Amount | | | | Maximum Number of Printable Sheets | | Current Number of Printed Sheets (Month) | Ink Low | Ink Empty | Order | | | | ··· |
|---|---|---|---|---|---|---|---|---|---|---|---|---|---|---|---|
| User Identification Information | Printer Identification Information | Bk | M | C | Y | Monochrome | Color | | | | Bk | M | C | Y | ··· |
| ABC | ADK83 | 150 | 2100 | 1100 | 100 | 500 | 50 | 1653 | ··· | ··· | ● | – | – | ● | ··· |
| ABC | AFC21 | 2500 | 2200 | 1500 | 1000 | Free | Free | 2500 | ··· | ··· | – | – | – | – | ··· |
| ABC | ANL45 | 1600 | – | – | – | 500 | – | 1152 | ··· | ··· | – | – | – | – | ··· |
| ⋮ | | ⋮ | | | | | | | | | | | | | |
| DEF | CKL01 | 1600 | 2100 | 1200 | 100 | 500 | 50 | 1860 | ··· | ··· | – | – | – | ● | ··· |
| ⋮ | | ⋮ | | | | | | | | | | | | | |

FIG. 11

IMAGE RECORDING APPARATUS, COMMUNICATION SYSTEM, AND COMPUTER-READABLE MEDIUM FOR PERMITTING ANOTHER APPARATUS TO TEMPORARILY USE A CARTRIDGE FOR THE IMAGE RECORDING APPARATUS

CROSS-REFERENCE TO RELATED APPLICATION

This application claims priority under 35 U.S.C. § 119 from Japanese Patent Application No. 2019-092549 filed on May 16, 2019. The entire subject matter of the application is incorporated herein by reference.

BACKGROUND

Technical Field

Aspects of the present disclosure are related to an image recording apparatus, a communication system, and a non-transitory computer-readable medium for permitting another apparatus to temporarily use a cartridge for the image recording apparatus.

Related Art

An inkjet printer provided by a service provider has been known. The service provider performs maintenance on the printer and/or provides a user with an ink cartridge for the printer.

SUMMARY

In an office or the like, a managed printer provided and managed by the service provider and an unmanaged printer that is not managed by the service provider may be used. An ink cartridge for the managed printer is assumed to be provided to a user who has subscribed to services provided by the service provider. Therefore, the ink cartridge for the managed printer may be provided to the user at a relatively low price. In this case, the ink cartridge for the managed printer may be permitted to be used in the unmanaged printer under restricted usage conditions. Nonetheless, for instance, when the user runs out of ink in the unmanaged printer, and is unable to use the unmanaged printer until a new ink cartridge for the unmanaged printer is delivered, the user may wish to temporarily use, in the unmanaged printer, an ink cartridge attached to the managed printer.

Aspects of the present disclosure are advantageous to provide one or more improved techniques for permitting an unmanaged printer to temporarily use a cartridge removed from a managed printer.

According to aspects of the present disclosure, an image recording apparatus is provided, which includes an attachment case configured to receive a cartridge removably attached thereto, the cartridge having a cartridge memory, a print engine configured to perform printing on a sheet, a cartridge interface, a communication interface, and a controller having a memory. The controller is configured to perform at least one of storing apparatus identification information stored in the memory, into the cartridge memory via the cartridge interface, and storing cartridge identification information stored in the cartridge memory, into the memory via the cartridge interface, receive permission application information from a permission-requesting image recording apparatus via the communication interface, determine whether or not reception identification information included in the received permission application information is identical to the apparatus identification information stored in the memory or the cartridge identification information stored in the memory, and transmit permission information to the permission-requesting image recording apparatus via the communication interface, when determining that the cartridge has been removed from the attachment case and determining that the reception identification information is identical to the apparatus identification information or the cartridge identification information, the permission information representing that the permission-requesting image recording apparatus is permitted to perform printing.

According to aspects of the present disclosure, further provided is an image recording apparatus that includes an attachment case configured to receive a cartridge removably attached thereto, the cartridge having a cartridge memory, a print engine configured to perform printing on a sheet, a cartridge interface, a communication interface, and a controller having a memory. The controller is configured to determine whether or not the controller has obtained, from the cartridge memory of the cartridge attached to the attachment case via the cartridge interface, cartridge identification information or apparatus identification information representing a permission-giving image recording apparatus, transmit, when determining that the controller has obtained the cartridge identification information or the apparatus identification information, permission application information including the cartridge identification information or the apparatus identification information to the permission-giving image recording apparatus via the communication interface, receive permission information from the permission-giving image recording apparatus via the communication interface, the permission information representing that the image recording apparatus is permitted to perform printing, and control the print engine to perform printing when receiving the permission information.

According to aspects of the present disclosure, further provided is an image recording apparatus that includes an attachment case configured to receive a cartridge removably attached thereto, the cartridge having a cartridge memory, a print engine configured to perform printing on a sheet, a cartridge interface, a communication interface, and a controller having a memory. The controller is configured to set an operation mode to a first mode when having not obtained specific information from the cartridge memory via the cartridge interface, set the operation mode to a second mode when having obtained the specific information from the cartridge memory via the cartridge interface, when the operation mode is set to the second mode, perform at least one of storing apparatus identification information stored in the memory, into the cartridge memory via the cartridge interface, and storing cartridge identification information stored in the cartridge memory, into the memory via the cartridge interface, receiving first permission application information from a permission-requesting image recording apparatus via the communication interface, determining whether or not reception identification information included in the received first permission application information is identical to the apparatus identification information stored in the memory or the cartridge identification information stored in the memory, and transmitting first permission information to the permission-requesting image recording apparatus via the communication interface, when determining that the cartridge has been removed from the attachment case and determining that the reception identification information is identical to the apparatus identification information or the cartridge identification information, the first permission information representing that the permission-requesting image recording apparatus is permitted to perform printing, and perform, when the operation mode is set to the first mode, determining whether or not the controller has obtained the apparatus identification information or the cartridge identification information from the cartridge memory via the cartridge interface, when determining that the controller has obtained the apparatus identification information or the cartridge identification information, transmitting second permission application information including the apparatus identification information or the cartridge identification information, to a permission-giving image recording apparatus via the communication interface, receiving second permission information from the permission-giving image recording apparatus via the communication interface, the second permission information representing that the image recording apparatus is permitted to perform printing, and controlling the print engine to perform printing, when receiving the second permission information.

According to aspects of the present disclosure, further provided is a communication system that includes a first image recording apparatus and a second image recording apparatus communicably connected with the first image recording apparatus. The first image recording apparatus includes a first attachment case configured to receive a cartridge removably attached thereto, the cartridge having a cartridge memory, a first print engine configured to perform printing on a sheet, a first cartridge interface, a first communication interface, and a first controller having a first memory. The first controller is configured to perform at least one of storing apparatus identification information stored in the first memory, into the cartridge memory via the first cartridge interface and storing cartridge identification information stored in the cartridge memory, into the first memory via the first cartridge interface, receive permission application information from the second image recording apparatus via the first communication interface, determine whether or not reception identification information included in the received permission application information is identical to the apparatus identification information stored in the first memory or the cartridge identification information stored in the first memory, and transmit permission information to the second image recording apparatus via the first communication interface, when determining that the cartridge has been removed from the first attachment case and determining that the reception identification information is identical to the apparatus identification information or the cartridge identification information, the permission information representing that the second image recording apparatus is permitted to perform printing. The second image recording apparatus includes a second attachment case configured to receive a cartridge removably attached thereto, the cartridge having a cartridge memory, a second print engine configured to perform printing on a sheet, a second cartridge interface, a second communication interface, and a second controller having a second memory. The second controller is configured to determine whether or not the second controller has obtained the cartridge identification information or the apparatus identification information from the cartridge memory of the cartridge attached to the second attachment case via the second cartridge interface, transmit, when determining that the second controller has obtained the cartridge identification information or the apparatus identification information, the permission application information including the cartridge identification information or the apparatus identification information to the first image recording apparatus via the second communication interface, receive the permission information from the first image recording apparatus via the second communication interface, and control the second print engine to perform printing, when receiving the permission information.

According to aspects of the present disclosure, further provided is a non-transitory computer-readable medium storing computer-readable instructions executable by a processor of an image recording apparatus. The image recording apparatus includes an attachment case configured to receive a cartridge removably attached thereto, the cartridge having a cartridge memory, a print engine configured to perform printing on a sheet, a cartridge interface, a communication interface, and a memory. The instructions are configured to, when executed by the processor, cause the processor to perform at least one of storing apparatus identification information stored in the memory into the cartridge memory via the cartridge interface and storing cartridge identification information stored in the cartridge memory into the memory via the cartridge interface, receive permission application information from a permission-requesting image recording apparatus via the communication interface, determine whether or not reception identification information included in the received permission application information is identical to the apparatus identification information stored in the memory or the cartridge identification information stored in the memory, and transmit permission information to the permission-requesting image recording apparatus via the communication interface, when determining that the cartridge has been removed from the attachment case and determining that the reception identification information is identical to the apparatus identification information or the cartridge identification information, the permission information representing that the permission-requesting image recording apparatus is permitted to perform printing.

According to aspects of the present disclosure, further provided is a non-transitory computer-readable medium storing computer-readable instructions executable by a processor of an image recording apparatus. The image recording apparatus includes an attachment case configured to receive a cartridge removably attached thereto, the cartridge having a cartridge memory, a print engine configured to perform printing on a sheet, a cartridge interface, a communication interface, and a memory. The instructions are configured to, when executed by the processor, cause the processor to determine whether or not the processor has obtained, from the cartridge memory of the cartridge attached to the attachment case via the cartridge interface, cartridge identification information or apparatus identification information representing a permission-giving image recording apparatus, transmit, when determining that the processor has obtained the cartridge identification information or the apparatus identification information, permission application information including the cartridge identification information or the apparatus identification information to the permission-giving image recording apparatus via the communication interface, receive permission information from the permission-giving image recording apparatus via the communication interface, the permission information representing that the image recording apparatus is permitted to perform printing, and control the print engine to perform printing, when receiving the permission information.

According to aspects of the present disclosure, further provided is a non-transitory computer-readable medium storing computer-readable instructions executable by a processor of an image recording apparatus. The image recording apparatus includes an attachment case configured to receive a cartridge removably attached thereto, the cartridge having a cartridge memory, a print engine configured to perform printing on a sheet, a cartridge interface, a communication interface, and a memory. The instructions are configured to, when executed by the processor, cause the processor to set an operation mode to a first mode when having not obtained specific information from the cartridge memory via the cartridge interface, set the operation mode to a second mode when having obtained the specific information from the cartridge memory via the cartridge interface, perform, when the operation mode is set to the second mode, at least one of storing apparatus identification information stored in the memory into the cartridge memory via the cartridge interface and storing cartridge identification information stored in the cartridge memory into the memory via the cartridge interface, receiving first permission application information from a permission-requesting image recording apparatus via the communication interface, determining whether or not reception identification information included in the received first permission application information is identical to the apparatus identification information stored in the memory or the cartridge identification information stored in the memory, and transmitting first permission information to the permission-requesting image recording apparatus via the communication interface, when determining that the cartridge has been removed from the attachment case and determining that the reception identification information is identical to the apparatus identification information or the cartridge identification information, the first permission information representing that the permission-requesting image recording apparatus is permitted to perform printing, perform, when the operation mode is set to the first mode, determining whether or not the processor has obtained the apparatus identification information or the cartridge identification information from the cartridge memory via the cartridge interface, when determining that the processor has obtained the apparatus identification information or the cartridge identification information, transmitting second permission application information including the apparatus identification information or the cartridge identification information, to a permission-giving image recording apparatus via the communication interface, receiving second permission information from the permission-giving image recording apparatus via the communication interface, the second permission information representing that the image recording apparatus is permitted to perform printing, and controlling the print engine to perform printing, when receiving the second permission information.

BRIEF DESCRIPTION OF THE ACCOMPANYING DRAWINGS

FIG. 11 shows an example of a management database stored in the information processing device in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an illustrative embodiment according to aspects of the present disclosure will be described with reference to the accompanying drawings.

Figure 1:
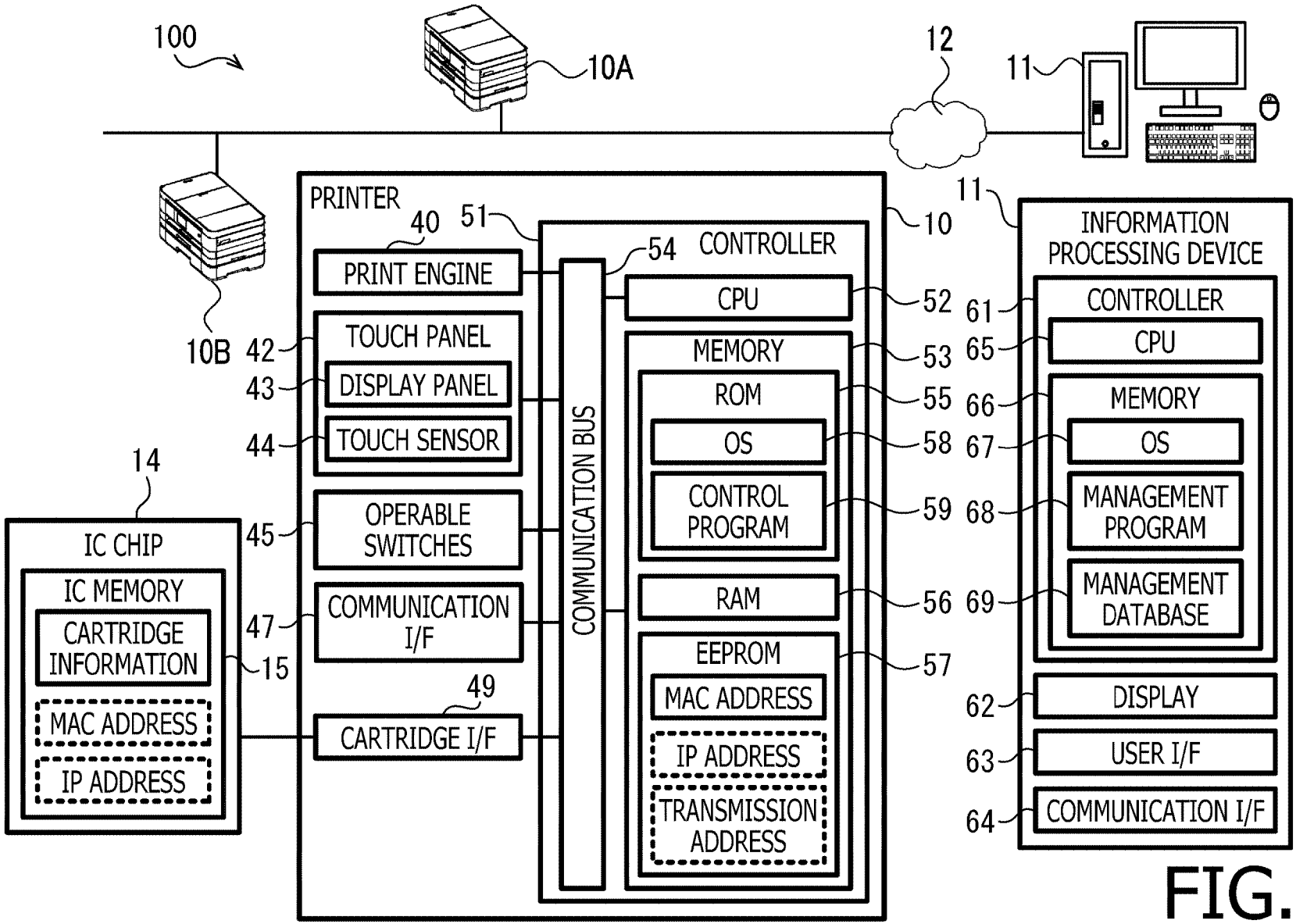
FIG. 1 is a functional block diagram schematically showing a configuration of a communication system including printers and an information processing device, in an illustrative embodiment according to one or more aspects of the present disclosure.

As shown in FIG. 1, a communication system 100 of the illustrative embodiment includes a managed printer 10A and an unmanaged printer 10B interconnected via a local network such as a LAN (registered trademark) and a WAN. The managed printer 10A is usable by a user who has signed a contract for the managed printer 10A with a service provider. The service provider provides a service to the user by using an information processing device 11. For instance, the service provider monitors an amount of ink remaining in each of below-mentioned cartridges 13 attached to the managed printer 10A by using the information processing device 11. Further, the service provider arranges an order for a new cartridge 13 when finding that only a small amount of ink is left in one of the cartridges 13 attached to the managed printer 10A. On the other hand, the unmanaged printer 10B is usable by the user without any contract for the unmanaged printer 10B with a service provider. Namely, the user may use the managed printer 10A and the unmanaged printer 10B.

In the illustrative embodiment, an example will be described in which the managed printer 10A and the unmanaged printer 10B are printers 10 having the same specifications. Namely, each of the printers 10 may be used as the managed printer 10A or may be used as the unmanaged printer 10B. Hereinafter, the managed printer 10A and the unmanaged printer 10B, when not distinguished from each other, may be referred to as the "printers 10."

As described above, the managed printer 10A and the unmanaged printer 10B are connected with the local network such as a LAN (registered trademark) and a WAN. The local network is connected with an Internet 12 via a router (not shown). The Internet 12 is connected with the information processing device 11 which the service provider is authorized to use. Thus, the managed printer 10A is enabled to communicate with the information processing device 11 through the local network and the Internet 12.

The information processing device 11 is, for instance, a server of which a URL is published on the Internet 12. The information processing device 11 includes a controller 61, a display 62, a user I/F ("I/F" is an abbreviation for "interface") 63, and a communication I/F 64. The user I/F 63 may include, but is not limited to, at least one of a mouse and a keyboard.

The controller 61 includes a CPU 65, a memory 66, and a communication bus (not shown). The CPU 65, the memory 66, the display 62, the user I/F 63, and the communication I/F 64 are connected to the communication bus. Namely, the CPU 65 is communicably connected with the memory 66, the display 62, the user I/F 63, and the communication I/F 64 via the communication bus, in such a manner as to be able to exchange information and data therewith.

The memory 66 may include, but is not limited to, at least one of a ROM, a RAM, and a hard disk drive. The hard disk drive stores an OS 67 and a management program 68. Instructions contained in the OS 67 and the management program 68 are executable by the CPU 65. In other words, the OS 67 and the management program 68 are executable by the CPU 65. The OS 67 and the management program 68 are configured to, when executed by the CPU 65, cause the controller 61 to display images on the display 62, receive user inputs via the user I/F 63, communicate information and data via the communication I/F 64, and store the received information and data into the memory. 66. The management program 68 is further configured to, when executed by the CPU 65, cause the controller 61 to store, into the memory 66, management information (e.g., the number of printed sheets and a remaining ink amount) obtained from the managed printer 10A. Specifically, the management program 68 manages identification information and the management information stored in the memory 66 in association with each other on a management database 69.

FIG. 11 shows an example of the management database 69. The management database 69 has a plurality of records and a plurality of items. Each single record indicates a corresponding managed printer 10A. The plurality of items may include, but are not limited to, "identification information," "remaining ink amount," "maximum number of printable sheets," "current number of printed sheets (month)," "ink low," "ink empty," and "order."

The item "identification information" has sub-items "user identification information" and "printer identification information." The item "user identification information" represents a user who has concluded a contract. The printer identification information is for individually identifying a managed printer 10A provided to a corresponding user. The printer identification information may include, but is not limited to, at least one of a MAC address, a serial number, an IP address, and a printer name of the managed printer 10A.

The item "remaining ink amount" has sub-items "Bk," "M," "C," and "Y." The sub-items "Bk," "M," "C," and "Y" indicate a remaining amount of black ink, a remaining amount of magenta ink, a remaining amount of cyan ink, and a remaining amount of yellow ink, respectively. The item "maximum number of printable sheets" has sub-items "monochrome" and "color." The sub-item "monochrome" indicates a maximum number of sheets printable within a particular period (e.g., one day, one week, and one month) in monochrome printing. The sub-item "color" indicates a maximum number of sheets printable within the particular period in color printing. The item "current number of printed sheets (month)" indicates a total number of sheets printed by the managed printer 10A in a current month. The item "current number of printed sheets (month)" is managed on the management database 69, for instance, in order for the service provider to issue a bill to the user. The item "ink low" represents that only a small amount of ink is left in one of the below-mentioned cartridges 13 attached to the managed printer 10A. The item "ink empty" represents that substantially no ink is remaining in one of the cartridges 13. Although the following features are not shown in any drawings, each of the items "ink low" and "ink empty" has sub-items "Bk," "M," "C," and "Y," respectively. The aforementioned items "remaining ink amount," "ink low," and "ink empty" are used as information for the service provider to order a new cartridge 13. The item "order" has sub-items "Bk," "M," "C," and "Y." For instance, the item "order" represents whether an order has been placed for a cartridge 13.

The items "identification information," "maximum number of printable sheets," and "order" are input to the information processing device 11 via the user I/F 63, for instance, by an operator of the service provider. The items "remaining ink amount," "current number of printed sheets (month)", "ink low", and "ink empty" are registered in the management database 69 by the controller 61 of the information processing device 11, based on the management information transmitted by the managed printer 10A. Specifically, the controller 61 specifies, on the management database 69, a record having the same printer identification information as contained in the received management information. The controller 61 registers a corresponding piece of information contained in the management information with each item of the specified record. For instance, the controller 61 adds a count of printed sheets for one day contained in the management information to the number represented by the item "current number of printed sheets (month)" and registers the obtained sum with the item.

Figure 2A:
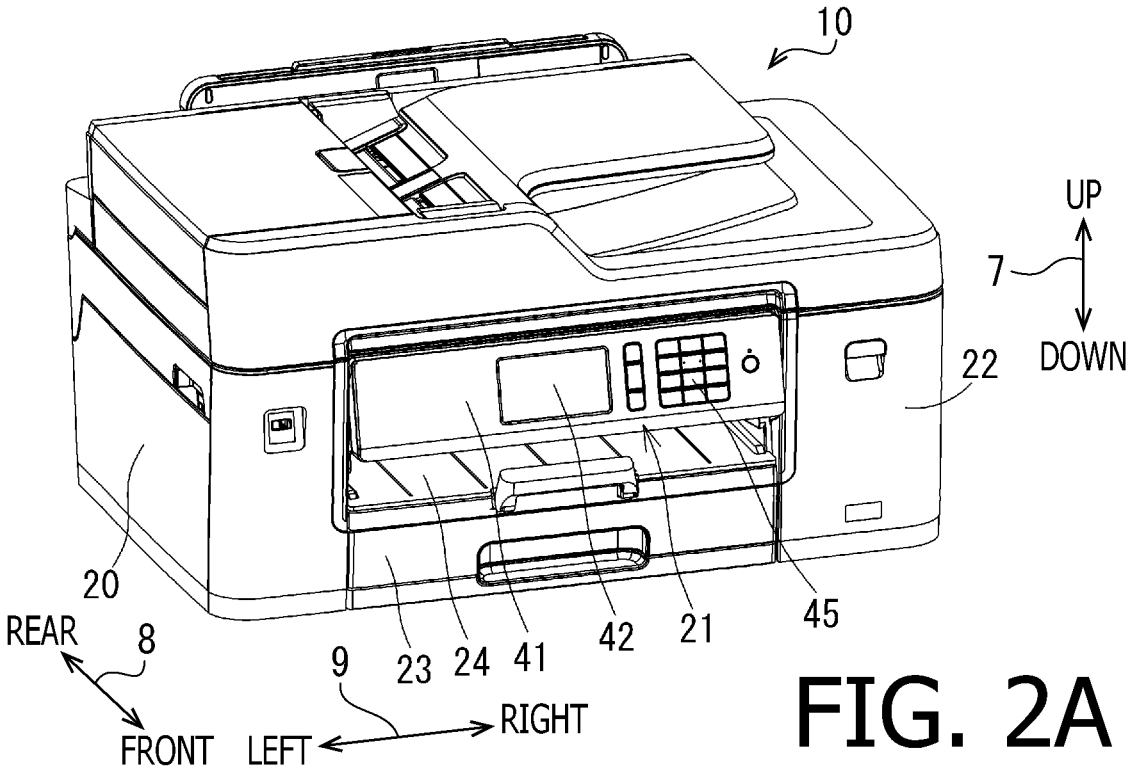
FIG. 2A is a perspective view showing an individual printer when a cover is closed, in the illustrative embodiment according to one or more aspects of the present disclosure.
Figure 2B:
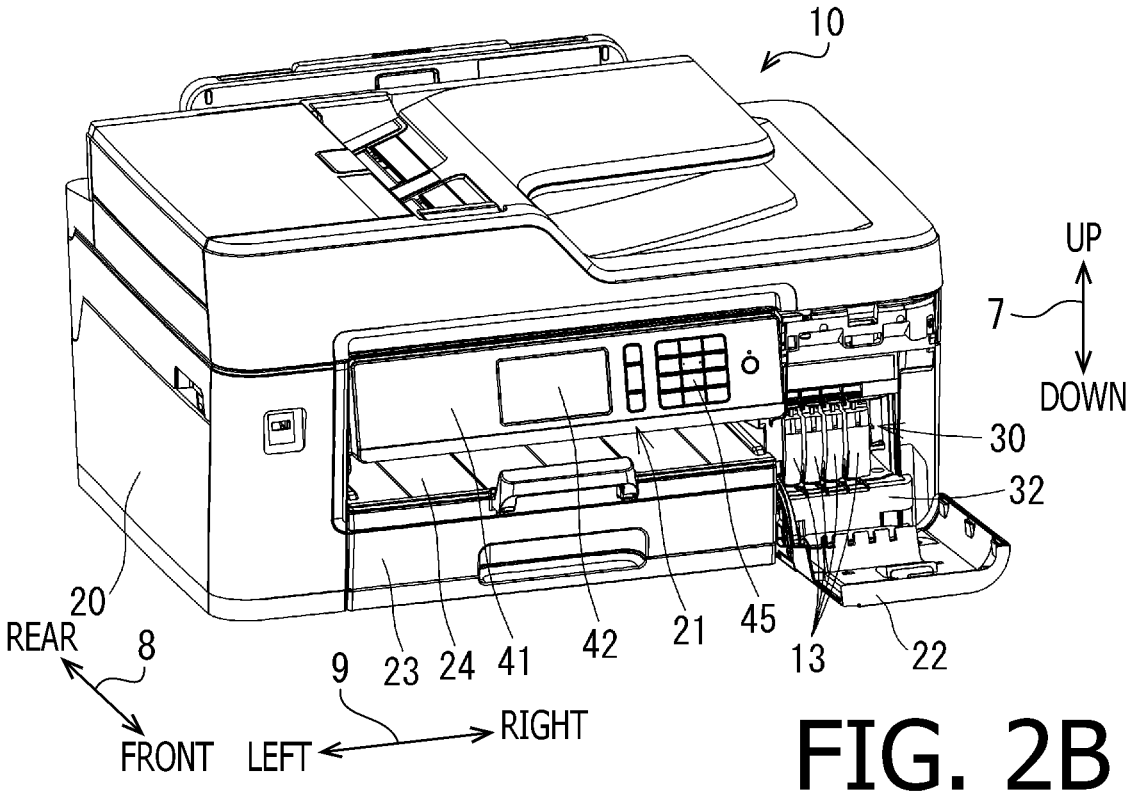
FIG. 2B is a perspective view showing the printer when the cover is open, in the illustrative embodiment according to one or more aspects of the present disclosure.

As shown in FIGS. 2A and 2B, each printer 10 includes a housing 20, and further includes a panel unit 21, a cover 22, a feed tray 23, and a discharge tray 24 that are held by the housing 20.

The panel unit 21 includes a panel main body 41, a touch panel 42 held by the panel main body 41, and a plurality of operable switches 45. The panel main body 41 has a rectangular plate shape. The panel main body 41 is attached to a surface of the housing 20. Hereinafter, in a state where the printer 10 is placed on a horizontal plane, a front-rear direction 8 is defined with the surface of the housing 20 to which the panel main body 41 is attached as a front surface. In this state, an up-down direction 7 is defined along a vertical direction. Further, a left-right direction 9 is defined along a direction from the left to the right when the printer 10 is viewed from the front. The front-rear direction 8 and the left-right direction 9 are parallel to the horizontal plane, are orthogonal to the up-down direction 7, and are orthogonal to each other.

As illustrated in FIG. 1, the touch panel 42 includes a display panel 43 configured to display an image, and a touch sensor 44 formed as a transparent film superimposed on the display panel 43. The touch sensor 44 is configured to output positional information representing a user-touched position on the display panel 43. For instance, the positional information may be coordinates (x, y) on an X-Y plane when an upper left end of the display panel 43 is defined as an origin, a rightward direction from the origin is defined as an X-axis direction (i.e., a positive direction of the X axis), and a downward direction from the origin is defined as a Y-axis direction (i.e., a positive direction of the Y axis).

The display panel 43 and the touch sensor 44 included in the touch panel 42 are connected with a below-mentioned controller 51 via a cable. The controller 51 is configured to output image data to the display panel 43 and cause the display panel 43 to display an image based on the image data. Further, the controller 51 receives the positional information output from the touch sensor 44. The controller 51 determines that an icon displayed in the position represented by the positional information received from the touch sensor 44 is a user-selected icon.

Each of the operable switches 45 has a contact point configured to be opened and closed based on a user operation. Each operable switch 45 is configured to output a detection signal having a different voltage value depending on whether the contact point is opened or closed. Each operable switch 45 is connected with the controller 51 via a cable. The controller 51 receives the detection signal from each operable switch 45. It is noted that the panel unit 21 may include, but is not limited to, at least one of the touch sensor 44 and the plurality of operable switches 45.

As shown in FIGS. 2A and 2B, the feed tray 23 is disposed below the housing 20. The feed tray 23 is detachably attached to the housing 20. The discharge tray 24 is disposed below the housing 20 and above the feed tray 23. The discharge tray 24 is held by the feed tray 23 or the housing 20. The cover 22 is disposed at a right portion of the front surface of the housing 20. The cover 22 is rotatably supported by the housing 20. The cover 22 is rotatable between a closed position and an open position. When in the closed position, the cover 22 closes an opening 30 formed at a right portion of the housing 20. Meanwhile, when in the open position, the cover 22 opens the opening 30. An attachment case 32 is disposed behind the opening 30. The attachment case 32 is held by the housing 20. The attachment case 32 is configured to hold the cartridges 13 in a detachable manner. Since such a configuration is known, a detailed description thereof will be omitted.

The attachment case 32 may hold one or more cartridges 13 in a detachable manner. In the illustrative embodiment, as shown in FIG. 2B, the attachment case 32 detachably holds four cartridges 13. For instance, each of the four cartridges 13 stores ink having a corresponding one of magenta, cyan, yellow, and black colors. Namely, each of the printers 10 is a color inkjet printer. Nonetheless, the attachment case 32 may be configured to detachably hold only one cartridge 13 for storing black ink. Namely, each of the printers 10 may be a monochrome printer. Further, the attachment case 32 may be configured to detachably hold one or more cartridges 13 for storing toner instead of ink. In other words, each of the printers 10 may be a laser printer.

The attachment case 32 has a cartridge I/F 49 (see FIG. 1) for each cartridge 13. For instance, each of the cartridge I/Fs 49 is a terminal. Each cartridge I/F 49 is disposed in a position in contact with an electrode (not shown) of an IC chip 14 of a corresponding one of the cartridges 13 attached to the attachment case 32. The cartridge I/Fs 49 are connected with the below-mentioned controller 51 via a cable (not shown).

It is noted that each of the cartridge I/Fs 49 may include an antenna. For instance, the attachment case 32 has, as an individual cartridge I/F 49, a substrate with a pattern antenna formed thereon. Similarly, the IC chip 14 is provided with an antenna. The cartridge I/F 49 is configured to output a radio wave to be received by the antenna of the IC chip 14 and receive a radio wave output from the antenna of the IC chip 14. Thus, the cartridge I/F 49 may receive information and data from the IC chip 14 and transmit information and data to the IC chip 14, via radio waves.

Further, each of the cartridge I/Fs 49 may include a light emitting diode and a photodiode. For instance, the attachment case 32 has, as an individual cartridge I/F 49, a substrate with a light emitting diode and a photodiode mounted thereon. Similarly, the IC chip 14 is provided with a light emitting diode and a photodiode. The cartridge I/F 49 is configured to emit light to be received by the photodiode of the IC chip 14 and receive light emitted by the light emitting diode of the IC chip 14. Thus, the cartridge I/F 49 may receive information and data from the IC chip 14 and transmit information and data to the IC chip 14, via light.

Each of the cartridges 13 is formed in a box shape having an internal space for storing ink. Since a basic configuration of each cartridge 13 is known, a detailed description thereof will be omitted. Each cartridge 13 has the IC chip 14. In the illustrative embodiment, the IC chip 14 is mounted on an upper surface of the corresponding cartridge 13. The IC chip 14 has the electrode (not shown) configured to be in contact with the cartridge I/F 49 as a terminal when the corresponding cartridge 13 is attached to the attachment case 32. Further, the IC chip 14 has an IC memory 15 electrically connected with the electrode. In another instance, the IC chip 14 may have an antenna such as a pattern antenna formed on a substrate, instead of the electrode. In yet another instance, the IC chip 14 may have a light emitting diode and a photodiode instead of the electrode. The IC memory 15 previously stores cartridge information. The cartridge information may include, but is not limited to, at least one of a model number, type information, and a CTG serial number.

The model number is identification information provided to the corresponding cartridge 13 based on the color of the ink stored in the cartridge 13 and/or a type of the ink such as dye or pigment. The type information represents whether the corresponding cartridge 13 is restricted to be used in the managed printer 10A or restricted to be used in the unmanaged printer 10B. Hereinafter, a cartridge 13 restricted to be used in the managed printer 10A will be referred to as a "contractual use type cartridge 13." Further, a cartridge 13 restricted to be used in the unmanaged printer 10B will be referred to as a "normal use type cartridge 13."

For instance, the type information is one-bit data indicating "0" or "1" stored at a particular address of the IC memory 15. For instance, "1" represents that the corresponding cartridge 13 is a contractual use type cartridge 13. Meanwhile, "0" represents that the cartridge 13 is a normal use type cartridge 13. Nonetheless, the type information may be included in the model number. Namely, in this case, the model number may indicate the color and the type of the ink stored in the corresponding cartridge 13 and also represent whether the corresponding cartridge 13 is a contractual use type cartridge 13 or a normal use type cartridge 13. The CTG serial number is for individually identifying the corresponding cartridge 13.

Further, the IC memory 15 is controlled, by the controller 51 of a corresponding printer 10, to store a MAC address of the printer 10 as printer identification information for identifying the printer 10. Nonetheless, the printer identification information is not limited to the MAC address but may be any type of information as long as the information enables identification of the printer 10. For instance, the printer identification information may be a serial number of the printer 10 or a unique number assigned to the printer 10 by the service provider. Further, the IC memory 15 is controlled to store a below-mentioned IP address of the printer 10.

Figure 3:
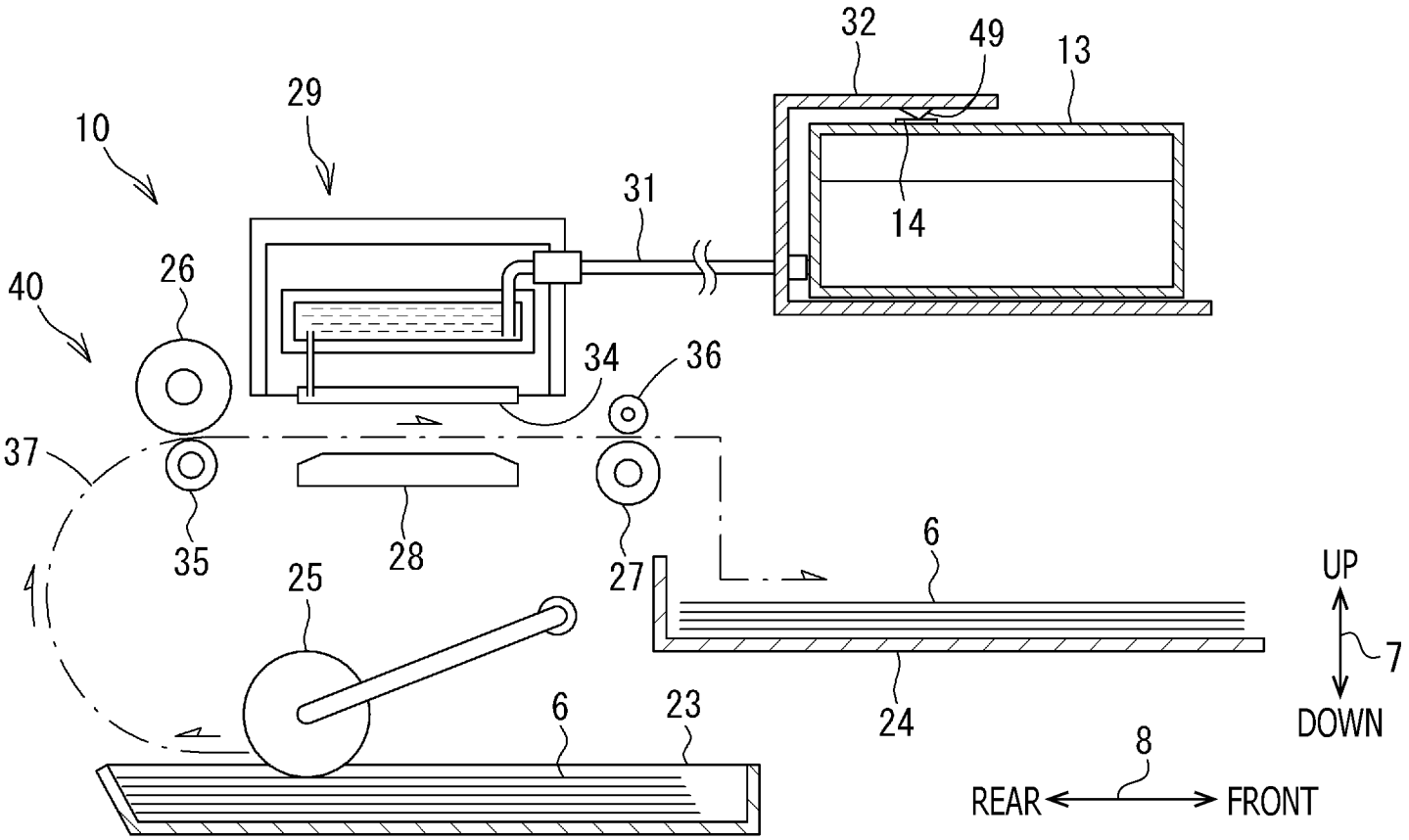
FIG. 3 is a cross-sectional side view schematically showing an internal configuration of the printer in the illustrative embodiment according to one or more aspects of the present disclosure.

The housing 20 supports a print engine 40 inside. The print engine 40 includes a pickup roller 25, a conveyance roller 26, a discharge roller 27, a platen 28, and a recording unit 29. The pickup roller 25 is supported by a frame (not shown) disposed in the housing 20, in such a manner as to be able to contact a sheet 6 placed on the feed tray 23. The pickup roller 25 is rotated by a motor (not shown). The pickup roller 25 is configured to, when rotated, feed the sheet 6 to a conveyance path 37. The conveyance path 37 is a space defined by a guide member (not shown). In the illustrative embodiment, as shown in FIG. 3, the conveyance path 37 extends in a curved manner from a rear end of the feed tray 23 to a position above the feed tray 23, and further extends frontward.

The conveyance roller 26 is located downstream of the feed tray 23 in a conveyance direction in which the sheet 6 is conveyed. The conveyance roller 26 and a driven roller 35 form a roller pair. The conveyance roller 26 is rotated by a motor (not shown). The conveyance roller 26 is configured to, when rotated, convey the sheet 6 fed to the conveyance path 37 by the pickup roller 25 while nipping the sheet 6 with the driven roller 35. The discharge roller 27 is located downstream of the conveyance roller 26 in the conveyance direction. The discharge roller 27 and a driven roller 36 form a roller pair. The discharge roller 27 is rotated by a motor (not shown). The discharge roller 27 is configured to, when rotated, convey the sheet 6 while nipping the sheet 6 with the driven roller 36, thereby discharging the sheet 6 onto the discharge tray 24. The platen 28 is located between the conveyance roller 26 and the discharge roller 27 in the front-rear direction 8. In other words, the platen 28 is located downstream of the conveyance roller 26 and upstream of the discharge roller 27 in the conveyance direction.

The recording unit 29 is located above the platen 28. The recording unit 29 may be supported, by a guiderail as a part of the frame, to be movable in the left-right direction 9, or may be fixed to the frame. Namely, each printer 10 may be a so-called serial printer or a so-called line printer. The recording unit 29 has a head 34. The head 34 has therein a flow path through which ink flows. The flow path is configured to communicate, via a tube 31, with the internal space of the cartridge 13 attached to the attachment case 32. Thus, the ink stored in the cartridge 13 is supplied to the head 34 via the tube 31.

As shown in FIG. 1, each printer 10 further includes the controller 51 and a communication I/F 47. The communication I/F 47 is connected with the aforementioned local network.

The controller 51 includes a CPU 52, a memory 53, and a communication bus 54. The CPU 52, the memory 53, the touch panel 42, the operable switches 45, the communication I/F 47, and the cartridge I/Fs 49 are connected with the communication bus 54. Namely, the CPU 52 is connected, via the communication bus 54, with the memory 53, the touch panel 42, the operable switches 45, the communication I/F 47, and the cartridge I/Fs 49 in such a manner as to be able to exchange information and data therewith.

The memory 53 is a memory unit including a plurality of memories such as a ROM 55, a RAM 56, and an EEPROM 57. The ROM 55 previously stores an OS 58 and a control program 59. Instructions contained in the OS 58 and the control program 59 are executable by the CPU 52. In other words, the OS 58 and the control program 59 are executable by the CPU 52. The OS 58 and the control program 59 are configured to, when executed by the CPU 52, cause the controller 51 to display images on the display panel 43 and receive user inputs via the touch sensor 44 and the operable switches 45. Further, the OS 58 and the control program 59 are configured to, when executed by the CPU 52, cause the controller 51 to transmit and receive information and data via the communication I/F 47 and the cartridge I/Fs 49 and store the received information and data into the memory 53.

The control program 59 may be a single program. In another instance, the control program 59 may include a plurality of modules such as a UI module, a communication module, and a print control module. Each module may be executed in a pseudo-parallel manner by so-called multitask processing.

The UI module is a program configured to, when executed by the CPU 52, cause the controller 51 to input image data to the display panel 43, control the display panel 43 to display images including objects such as icons, and receive signals output from the touch sensor 44 or the operable switches 45. The communication module is a program configured to, when executed by the CPU 52, cause the controller 51 to transmit and receive information and data in accordance with a communication protocol for the local network connected with the communication I/F 47. The print control module is a program configured to, when executed by the CPU 52, cause the controller 51 to generate and output drive signals to be input to drive circuits for one or more motors included in the printer 10 and/or to a drive circuit for driving elements included in the head 34 based on print data.

The RAM 56 is used for the CPU 52 to execute the OS 58 and the control program 59. The RAM 56 temporarily stores information and data when the CPU 52 executes the OS 58 and the control program 59. The EEPROM 57 previously stores a MAC address and a serial number of the corresponding printer 10. The EEPROM 57 stores an IP address and a transmission address input to the printer 10. The IP address is a private IP address set for the printer 10 on the local network. The transmission address may be, for instance, a URL published on the Internet by the information processing device 11. For instance, the IP address and the transmission address may be input to the printer 10 by the service provider via the touch sensor 44 or the operable switches 45. In another instance, the IP address and the transmission address may be input to the printer 10 from a terminal device (e.g., a tablet and a mobile terminal) via the communication I/F 47. In yet another instance, the IP address may be input to the printer 10 from the aforementioned router via the communication I/F 47.

Figure 4A:
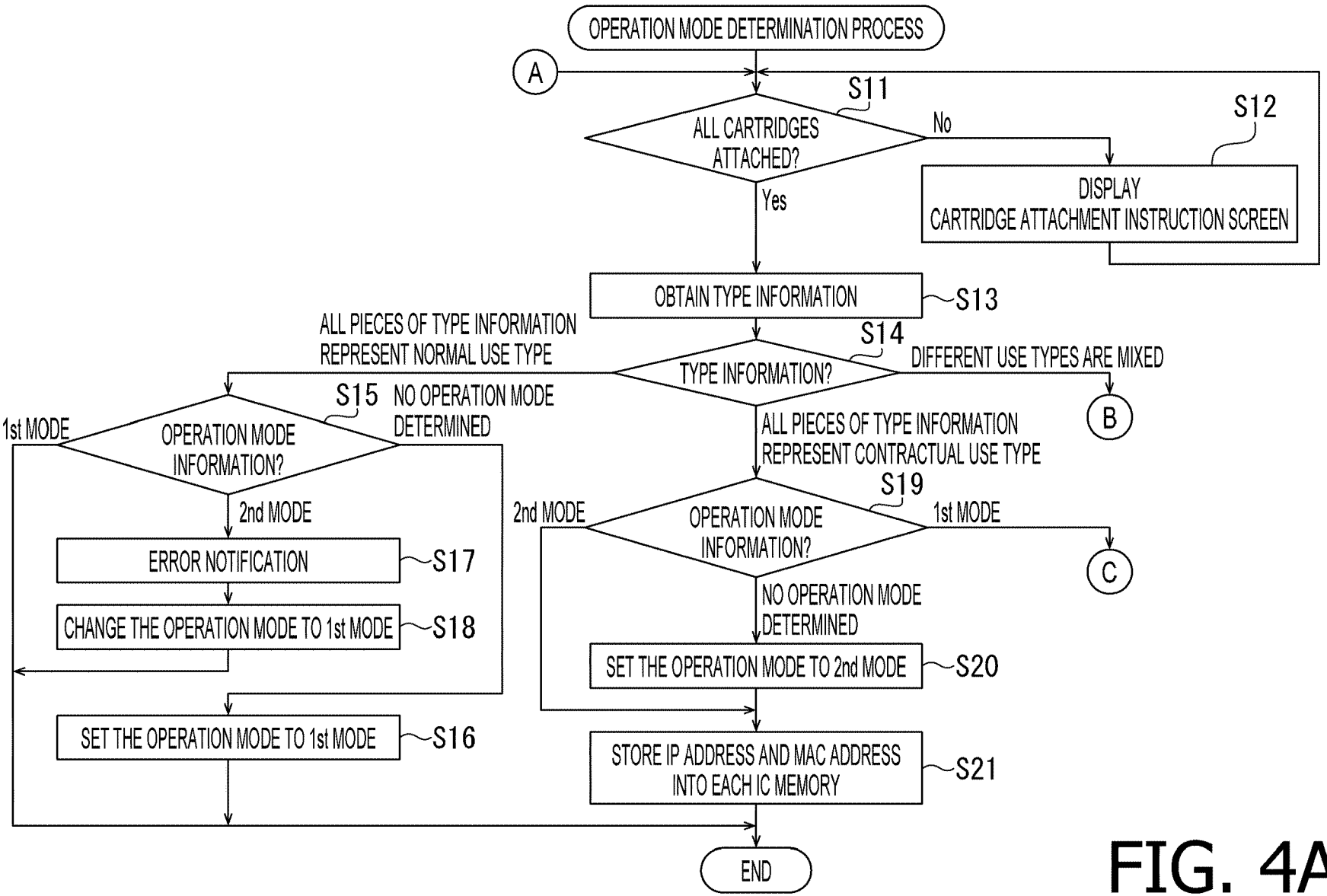
FIGS. 4A and 4B are flowcharts showing a procedure of an operation mode determination process to be performed by the printer, in the illustrative embodiment according to one or more aspects of the present disclosure.
Figure 4B:
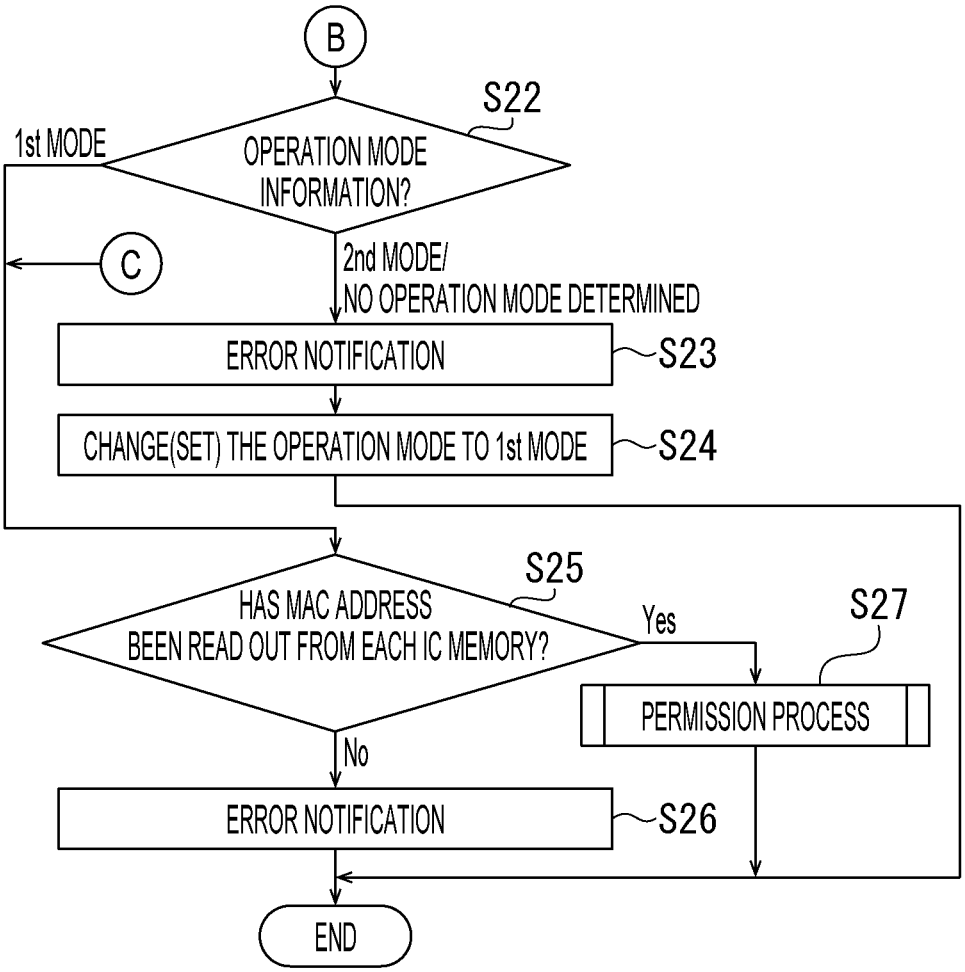

Hereinafter, processing by the controller 51 of an individual printer 10 will be described. First, an operation mode determination process to be performed by the controller 51 will be described with reference to FIGS. 4A and 4B. The operation mode determination process is a process for determining whether the printer 10 operates as the managed printer 10A or the unmanaged printer 10B.

For instance, the controller 51 may periodically execute the operation mode determination process. In another instance, the controller 51 may execute the operation mode determination process in response to the printer 10 being powered on. First, the controller 51 determines whether each of the necessary cartridges 13 is attached to the attachment case 32 (S11). Specifically, the controller 51 determines whether the controller 51 is enabled to communicate with the IC chip 14 of an individual cartridge 13 via the corresponding cartridge I/F 49. When determining that the controller 51 is enabled to communicate with the IC chip 14 of the cartridge 13 via the corresponding cartridge I/F 49, the controller 51 determines that the cartridge 13 is attached to the attachment case 32 (S11: Yes). Meanwhile, when determining that the controller 51 is unable to communicate with the IC chip 14 of the cartridge 13 via the corresponding cartridge I/F 49, the controller 51 determines that the cartridge 13 is not attached to the attachment case 32 (S11: No). It is noted that the controller 51 may perform any kind of processing other than the above process in S11 as long as the processing enables determination as to whether each of the necessary cartridges 13 is attached to the attachment case 32.

The controller 51 makes the determination in S11 for all the cartridges 13 to be attached to the attachment case 32. When determining that at least one of the necessary cartridges 13 is not attached to the attachment case 32 (S11: No), the controller 51 causes the display panel 43 to display a cartridge attachment instruction screen (S12). Specifically, the controller 51 reads out image data representing the cartridge attachment instruction screen previously stored in the ROM 55 of the memory 53 and sends the image data to the display panel 43. The cartridge attachment instruction screen is, for example, a screen including a text for prompting the user to open the cover 22 and attach one or more necessary cartridges 13 to the attachment case 32. It is noted that when displaying below-mentioned other screens on the display panel 43 as well, the controller 51 reads out image data representing the other screens from the memory 53 and sends the read image data to the display panel 43.

The controller 51 causes the display panel 43 to display the cartridge attachment instruction screen until the controller 51 determines that all of the necessary cartridges 13 have been attached to the attachment case 32. When the controller 51 determines that all of the necessary cartridges 13 are attached to the attachment case 32 (S11: Yes), the controller 51 obtains the aforementioned type information from each of the IC memories 15 via the corresponding cartridge I/F 49 (S13). Then, the controller 51 determines whether, among all pieces of the type information obtained from the IC memories 15 of all the cartridges 13 attached to the attachment case 32, all the pieces represent the normal use type, all the pieces represent the contractual use type, or mixed are the different use types, i.e., some piece(s) representing the normal use type and the other piece(s) representing the contractual use type (S14). Specifically, the controller 51 determines whether, among all pieces of the obtained type information, all the pieces are "0" representing the normal use type, all the pieces are "1" representing the contractual use type, or mixed are the different use types, i.e., some piece(s) of "0" representing the normal use type and the other piece(s) of "1" representing the contractual use type.

When the model number of each cartridge 13 represents the use type, the controller 51 obtains the model number from the IC memory 15 of each cartridge 13. Then, the controller 51 determines whether the obtained model number is identical to a model number previously stored in the memory 53 as a model number representing the normal use type, and determines whether the obtained model number is identical to a model number previously stored in the memory 53 as a model number representing the contractual use type.

When determining that all pieces of the obtained type information represent the normal use type (S14: All represent the normal use type), the controller 51 determines whether operation mode information stored in the memory 53 represents a first mode, a second mode, or no operation mode determined (S15). The operation mode information is information to be stored in the EEPROM 57 of the memory 53 based on the operation mode being determined by the controller 51. For instance, the operation mode information includes respective values of a first mode flag and a second mode flag stored in the EEPROM 57. The first mode flag having a value of "ON" (with the second mode flag having a value of "OFF") represents the first mode. The second mode flag having a value of "ON" (with the first mode flag having a value of "OFF") represents the second mode. The first mode flag and the second mode flag both having the value of "OFF" represent that there is no operation mode determined. The initial values of the first mode flag and the second mode flag are "OFF." The first mode is a mode in which the printer 10 operates as the unmanaged printer 10B. The second mode is a mode in which the printer 10 operates as the managed printer 10A.

The controller 51 determines that the operation mode information represents no operation mode determined, based on the first mode flag having the value "OFF" and the second mode flag having the value "OFF" being stored in the EEPROM 57 (S15: No operation mode determined). When determining that the operation mode information represents no operation mode determined (S15: No operation mode determined), the controller 51 determines the operation mode to be the first mode (S16). Then, the controller 51 terminates the operation mode determination process. Specifically, the controller 51 stores the first mode flag having the value "ON" in the EEPROM 57. Thus, when the cartridges 13 each of which is of the normal use type are attached to the attachment case 32 of the printer 10 with no operation mode determined, the operation mode is set to the first mode.

The controller 51 determines that the operation mode information represents the first mode, based on the first mode flag having the value "ON" and the second mode flag having the value "OFF" being stored in the EEPROM 57 (S15: First mode). When determining that the operation mode information represents the first mode (S15: First mode), the controller 51 terminates the operation mode determination process. Thus, when the cartridges 13 each of which is of the normal use type are attached to the attachment case 32 of the unmanaged printer 10B of which the operation mode is determined to be the first mode, the operation mode is maintained to be the first mode.

The controller 51 determines that the operation mode information represents the second mode, based on the first mode flag having the value "OFF" and the second mode flag having the value "ON" being stored in the EEPROM 57 (S15: Second mode). When determining that the operation mode information represents the second mode (S15: Second mode), the controller 51 issues an error notification (S17). Specifically, the controller 51 reads out image data representing an error display screen previously stored in the ROM 55 of the memory 53, and inputs the read image data to the display panel 43. Thus, when the cartridges 13 each of which is of the normal use type are attached to the attachment case 32 of the managed printer 10A of which the operation mode is determined to be the second mode, the error display screen is displayed on the display panel 43.

For instance, the error display screen includes an "OK" icon, a "Cancel" icon, and a text "An improper cartridge is included in the attached cartridges. Please attach a proper cartridge." Although the following features are not shown in the flowchart, the controller 51 again performs S11 and the subsequent steps in response to the "OK" icon being selected on the error display screen. For instance, the user selects the "OK" icon on the error display screen after re-attaching, to the attachment case 32, a contractual use type cartridge 13 that is a proper cartridge 13. When determining that the "Cancel" icon is selected on the error display screen, the controller 51 changes the operation mode to the first mode (S18). Specifically, the controller 51 stores the first mode flag having the value "ON" and the second mode flag having the value "OFF" in the EEPROM 57. After S18, the controller 51 terminates the operation mode determination process.

When determining in S14 that all pieces of the obtained type information represent the contractual use type (S14: All represent the contractual use type), the controller 51 performs the same process as executed in S15 (S19). When determining that the operation mode information stored in the EEPROM 57 represents no operation mode determined (S19: No operation mode determined), the controller 51 determines the operation mode to be the second mode (S20). Specifically, the controller 51 stores the second mode flag having the value "ON" in the EEPROM 57. Thus, in the printer 10 with no operation mode determined, when all of the cartridges 13 attached to the attachment case 32 are of the contractual use type, the operation mode is set to the second mode. Then, the controller 51 stores, into each IC memory 15, the IP address and the MAC address stored in the EEPROM 57 of the memory 53 (S21). Afterward, the controller 51 terminates the operation mode determination process.

When determining that the operation mode information stored in the EEPROM 57 represents the second mode (S19: Second mode), the controller 51 executes the aforementioned step S21. Namely, when a cartridge 13 is replaced with another cartridge 13 in the managed printer 10A with the second mode determined as the operation mode thereof, the MAC address and the IP address of the printer 10 are stored into the IC memory 15 of the said another cartridge 13 of the contractual use type, and the operation mode is maintained to be the second mode. After S21, the controller 51 terminates the operation mode determination process.

When determining that the operation mode information stored in the EEPROM 57 represents the first mode (S19: First mode), the controller 51 determines whether the MAC address and the IP address have been read out of each IC memory 15 via the cartridge I/F 49 (S25). Namely, in S25, it is determined whether each of the cartridges 13 attached to the attachment case 32 is a cartridge 13 that had been attached to the managed printer 10A.

When determining that the MAC address and the IP address have not been read out of each IC memory 15 via the cartridge I/F 49 (S25: No), the controller 51 issues an error notification in the same manner as in S17 (S26). Thereafter, the controller 51 terminates the operation mode determination process.

Although the following features are not shown in the flowchart, the controller 51 again performs S11 and the subsequent steps in response to the "OK" icon being selected on the error display screen. For instance, the user selects the "OK" icon on the error display screen after re-attaching, to the attachment case 32, a normal use type cartridge 13 that is a proper cartridge 13. When determining that the "Cancel" icon has been selected on the error display screen, the controller 51 terminates the operation mode determination processing.

When determining that the MAC address and the IP address have been read out of each IC memory 15 (S25: Yes), the controller 51 performs a permission process (S27). The permission process will be described with reference to FIG. 5. It is noted that the permission process is launched by the controller 51 of the printer 10 of which the operation mode is set to the first mode. Namely, the permission process is started by the controller 51 of the unmanaged printer 10B. Hereinafter, the controller 51 of the unmanaged printer 10B will be referred to as the "controller 51B." Further, the controller 51 of the managed printer 10A will be referred to as the "controller 51A."

First, the controller 51B of the unmanaged printer 10B generates permission application information (S31). The permission application information is, for instance, a command representing an application for permission for printing. The command includes the MAC address read out of the IC memories 15 in S25, the aforementioned model number (included in the cartridge information) read out of each IC memory 15, and the printer name of the unmanaged printer 10B. The printer name may be a model name of the unmanaged printer 10B or a name set for the unmanaged printer 10B by the user. The controller 51B transmits generated permission application information to the managed printer 10A represented by the IP address read out of the IC memories 15 in S25 (S32).

The controller 51A of the managed printer 10A receives the permission application information from the unmanaged printer 10B (S32). Then, the controller 51A determines whether the MAC address included in the received permission application information is identical to the MAC address of the managed printer 10A stored in the EEPROM 57 of the memory 53 (S33).

When determining that the MAC address included in the received permission application information is not identical to the MAC address of the managed printer 10A stored in the EEPROM 57 of the memory 53 (S33: No), the controller 51A transmits non-permission information to the unmanaged printer 10B as a reply to the permission application information (S37). The non-permission information is information representing that the unmanaged printer 10B is not permitted to perform printing using a contractual use type cartridge 13.

When determining that the MAC address included in the received permission application information is identical to the MAC address of the managed printer 10A stored in the EEPROM 57 of the memory 53 (S33: Yes), the controller 51A determines whether a cartridge 13, which stores ink of a color specified by the model number included in the received permission application information, is attached to the attachment case 32 (S34). When determining that the cartridge 13 for the specified color ink is attached to the attachment case 32 (S34: Yes), the controller 51A transmits the non-permission information to the unmanaged printer 10B as a reply to the permission application information (S37). Namely, when the cartridge 13 for the specified color ink is attached to the managed printer 10A, the controller 51A gives priority to printing by the managed printer 10A and transmits the non-permission information to the unmanaged printer 10B. It is noted that when both the managed printer 10A and the unmanaged printer 10B perform printing, the controller 51A of the managed printer 10A is unable to calculate an amount of ink remaining in the cartridge 13 for the specified color ink. Therefore, when the managed printer 10A performs printing, the controller 51A of the managed printer 10A does not permit the unmanaged printer 10B to perform printing using the contractual use type cartridge 13.

Figure 9A:
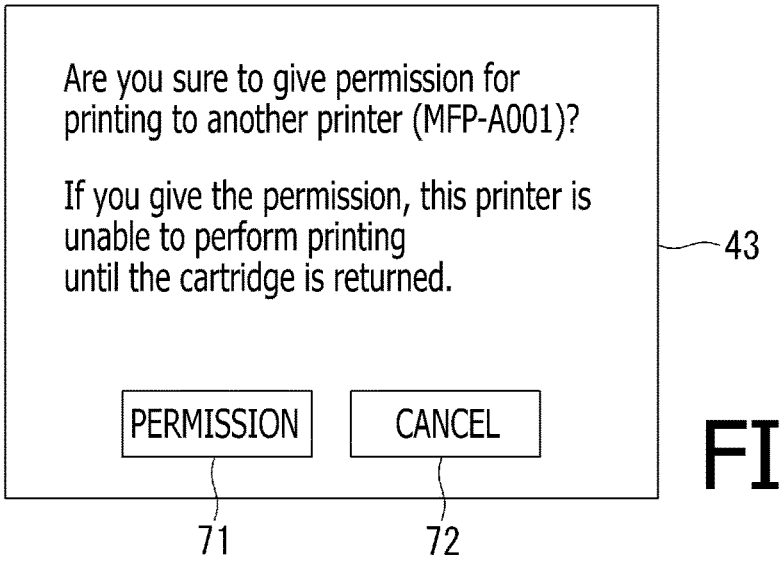
FIG. 9A shows an example of a first permission confirmation screen displayed on a display panel of the managed printer, in the illustrative embodiment according to one or more aspects of the present disclosure.

When determining that the cartridge 13, which stores the ink of the color specified by the model number included in the received permission application information, is not attached to the attachment case 32 (S34: No), the controller 51A controls the display panel 43 to display a first permission confirmation screen (S35). FIG. 9A shows an example of the first permission confirmation screen. As shown in FIG. 9A, the first permission confirmation screen includes a text "Are you sure to give permission for printing to another printer (MFP-A001)? If you give the permission, this printer is unable to perform printing until the cartridge is returned." Further, the first permission confirmation screen includes a "Permission" icon 71 and a "Cancel" icon 72. The aforementioned "MFP-A001" is a printer name of the unmanaged printer 10B that is included in the permission application information.

Figure 5:
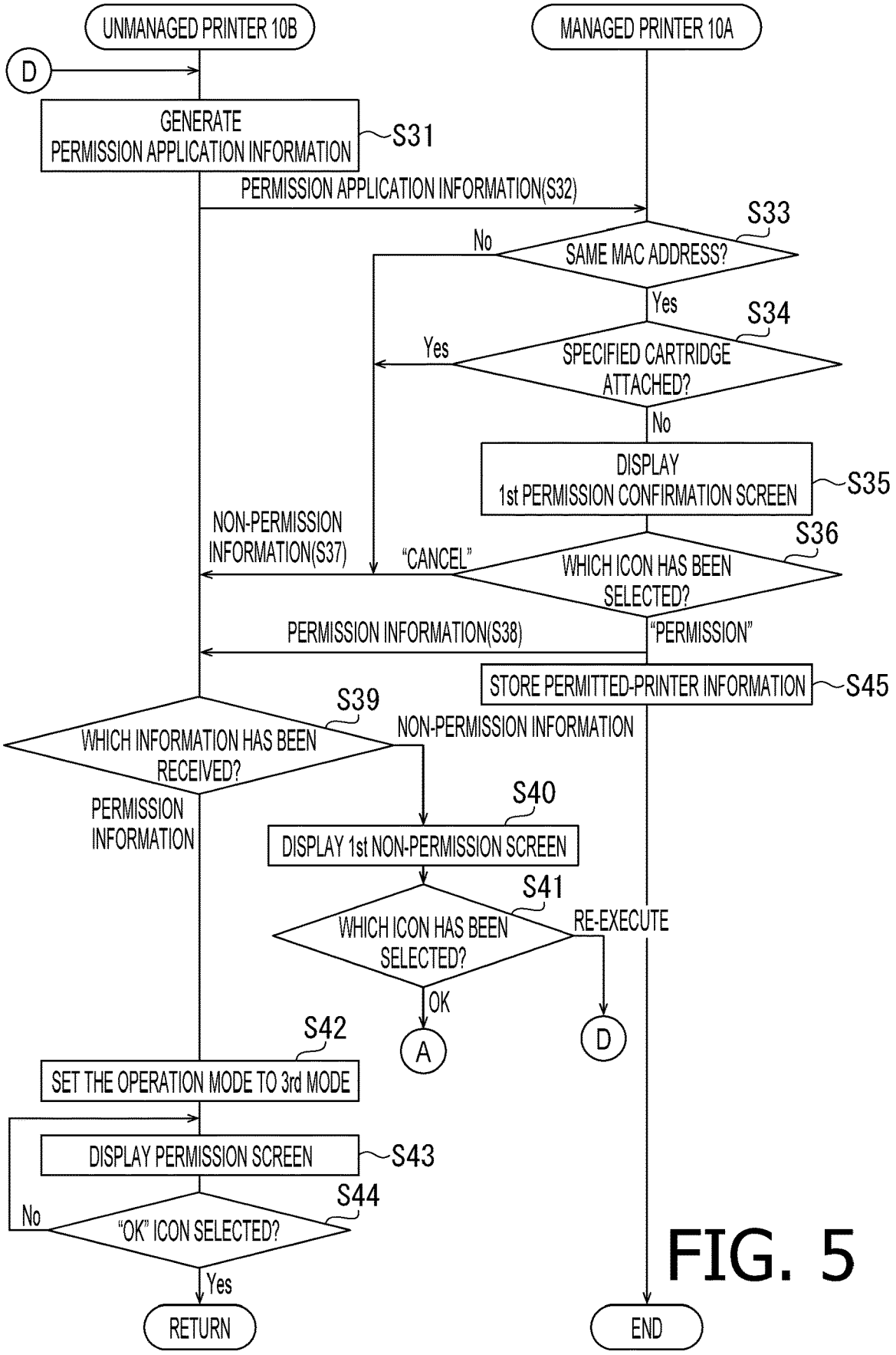
FIG. 5 illustrates a procedure of a permission process to be performed by an unmanaged printer and a managed printer, in the illustrative embodiment according to one or more aspects of the present disclosure.

As shown in FIG. 5, the controller 51A determines which icon has been selected of the "Permission" icon 71 and the "Cancel" icon 72 (S36). When determining that the selected icon is the "Cancel" icon 72 (S36: Cancel), the controller 51A transmits the non-permission information to the unmanaged printer 10B as a reply to the permission application information (S37). When determining that the selected icon is the "Permission" icon 71 (S36: Permission), the controller 51A transmits permission information to the unmanaged printer 10B as a reply to the permission application information (S38). The permission information is, for instance, a command for permitting the unmanaged printer 10B to perform printing.

Based on the transmission of the permission information to the unmanaged printer 10B, the controller 51A stores printer identification information for identifying the unmanaged printer 10B into the EEPROM 57 as permitted-printer information representing the printer 10 permitted to perform printing (S45). The printer identification information may include, but is not limited to, at least one of the MAC address, the serial number, the IP address, and the printer name of the unmanaged printer 10B. The printer identification information is included in the permission application information. Namely, the controller 51A stores the printer identification information included in the permission application information into the EEPROM 57 as the permitted-printer information.

Figure 10A:
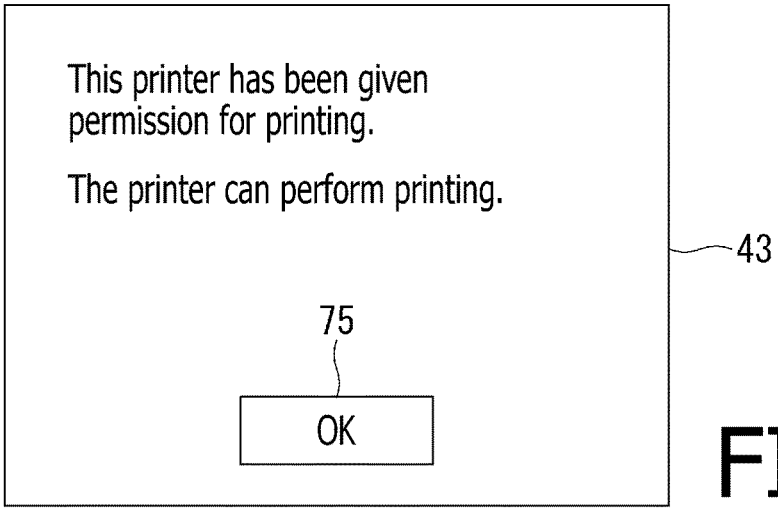
FIG. 10A shows an example of a permission screen displayed on a display panel of the unmanaged printer, in the illustrative embodiment according to one or more aspects of the present disclosure.
Figure 10B:
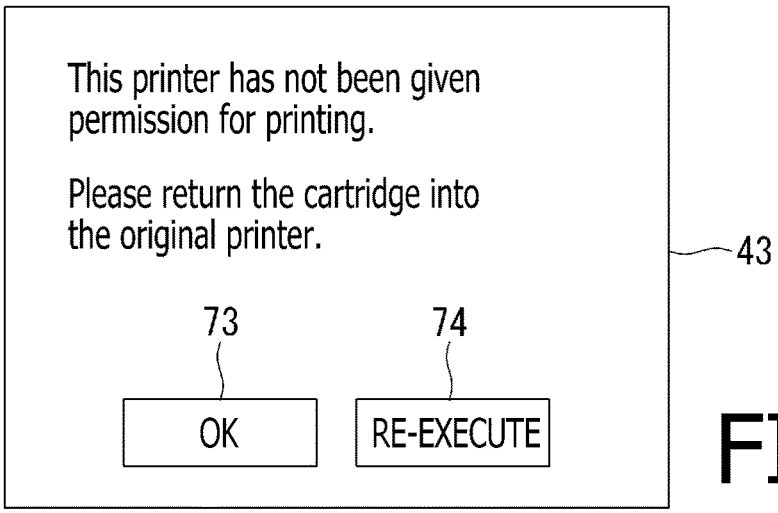
FIG. 10B shows an example of a first non-permission screen displayed on the display panel of the unmanaged printer, in the illustrative embodiment according to one or more aspects of the present disclosure.

The controller 51B of the unmanaged printer 10B receives the non-permission information or the permission information transmitted by the managed printer 10A as a reply to the permission application information (S37 or S38). Then, the controller 51B determines whether the received reply includes the permission information or the non-permission information (S39). When determining that the received reply includes the non-permission information (S39: Non-permission information), the controller 51B controls the display panel 43 to display a first non-permission screen (S40). FIG. 10B shows an example of the first non-permission screen. The first non-permission screen includes an "OK" icon 73, a "Re-execute" icon 74, and a text "This printer has not been given permission for printing. Please return the cartridge into the original printer."

The controller 51B waits until the user selects the "OK" icon 73 or the "Re-execute" icon 74 on the first non-permission screen. For instance, the user may replace a cartridge 13 attached to the attachment case 32 with another cartridge 13 removed from the managed printer 10A, and may select the "Re-execute" icon 74. In another instance, the user may replace a cartridge 13 attached to the attachment case 32 with another cartridge 13 of the normal use type, and may select the "OK" icon 73. Then, the controller 51B determines whether the icon selected by the user is the "OK" icon 73 or the "Re-execute" icon 74 (S41).

When determining that the icon selected by the user is the "Re-execute" icon 74 (S41: Re-execute), the controller 51B again executes S31 and the subsequent steps. When determining that the icon selected by the user is the "OK" icon 73 (S41: OK), the controller 51B again executes S11 and the subsequent steps.

When determining in S39 that the received reply includes the permission information (S39: Permission), the controller 51B sets the operation mode to a third mode (S42). Specifically, the controller 51B stores "ON" in a storage area preset in the EEPROM 57 as a storage area for a third mode flag representing whether the third mode is determined as the operation mode, and stores "OFF" in a storage area preset in the EEPROM 57 as a storage area for the first mode flag representing whether the first mode is determined as the operation mode. It is noted that an initial value of the third mode flag is "OFF."

Subsequently, the controller 51B controls the display panel 43 to display a permission screen representing that the unmanaged printer 10B has been given permission for printing (S43). FIG. 10A shows an example of the permission screen. As shown in FIG. 10A, the permission screen includes an "OK" icon 75 and a text "This printer has been given permission for printing. The printer can perform printing." As illustrated in FIG. 5, the controller 51B determines whether the "OK" icon 75 has been selected by the user on the permission screen (S44). The controller 51B causes the display panel 43 to display the permission screen until the "OK" icon 75 is selected (S44: No). When determining that the "OK" icon 75 has been selected on the permission screen (S44: Yes), the controller 51B terminates the permission processing (S27) and also terminates the operation mode determination process shown in FIGS. 4A and 4B.

Subsequently, a print transmission process will be described with reference to FIG. 7. The print transmission process is a process in which the managed printer 10A performs printing and transmits the management information to the information processing device 11.

Based on acquisition of a print instruction and print data, the controller 51A of the managed printer 10A performs the print transmission process. First, the controller 51A determines whether a value of an empty flag for each cartridge 13 is "ON" (S71). In other words, in S71, it is determined whether there remains enough ink for printing in each cartridge 13. More specifically, the empty flag for an individual cartridge 13 is configured to be set to "ON" in response to an amount of ink stored in the cartridge 13 being less than a second threshold (e.g., zero) previously stored in the EEPROM 57 (see S79). An initial value of the empty flag is "OFF." Although the following features are not shown in the flowchart, the empty flag is set to "OFF" based on replacement of the corresponding cartridge 13.

When determining that the value of the empty flag for at least one cartridge 13 is "ON" (S71: Yes), the controller 51A terminates the print transmission process. Namely, in this case, the controller 51A terminates the print transmission process without performing printing. When determining that the value of the empty flag for each cartridge 13 is "OFF" (S71: No), the controller 51A performs printing of one page based on the acquired print data (S72). Specifically, based on the acquired print data, the controller 51A generates a drive signal to be input to the drive circuit for the driving elements of the head 34, and generates drive signals to be input to the drive circuits for the one or more motors for rotating a plurality of rollers such as the pickup roller 25, the conveyance roller 26, and the discharge roller 27. Then, the controller 51A outputs the generated drive signals and causes the print engine 40 to perform printing of one page.

Next, the controller 51A counts the number of times the driving elements of the head 34 have been driven (S73). Hereinafter, the counted value of the number of times the driving elements of the head 34 have been driven will be referred to as an "ink dot value." The ink dot value represents an amount of ink used for printing. It is noted that when ink is sucked from the head 34 by a pump of a maintenance mechanism (not shown), an amount of the sucked ink is converted into an ink dot value. Namely, the ink dot value is a value indicating an amount of used ink.

Subsequently, the controller 51A obtains a pre-printing remaining amount read out from the IC memory 15 of each of the cartridges 13 attached to the attachment case 32, the EEPROM 57, or the RAM 56 (S74). Then, the controller 51A calculates a post-printing remaining amount by subtracting the ink dot value from the obtained pre-printing remaining amount (S75). Further, the controller 51A stores into the RAM 56 the calculated post-printing remaining amount. It is noted that the above method for calculating the post-printing remaining amount is just an example, and the post-printing remaining amount may be calculated in any other applicable methods. For instance, the attachment case 32 may have a sensor configured to detect whether a liquid level of the ink stored in each of the cartridges 13 attached to the attachment case 32 has reached a particular height position. In this case, the controller 51A may calculate the post-printing remaining amount by using a detection signal output from the sensor.

The controller 51A determines whether the calculated post-printing remaining amount is less than a first threshold previously stored in the EEPROM 57 (S76). When determining that the calculated post-printing remaining amount is less than the first threshold (S76: Yes), the controller 51A sets an ink low flag to "ON." Specifically, the value "ON" is stored in a particular storage area of the EEPROM 57 set as the ink low flag. When determining that the calculated post-printing remaining amount is not less than the first threshold (S76: No), the controller 51A skips S77 and goes to S78. In S78, the controller 51A determines whether the calculated post-printing remaining amount is less than a second threshold previously stored in the EEPROM 57 (S78). The second threshold is a value smaller than the first threshold. The second threshold is, for example, zero. Namely, in S78, it is determined whether an amount of ink required for printing is stored in each cartridge 13.

When determining that the calculated post-printing remaining amount is less than the second threshold (S78: Yes), the controller 51A sets the empty flag to "ON" (S79). Meanwhile, when determining that the calculated post-printing remaining amount is not less than the second threshold (S78: No), the controller 51A skips S79 and goes to S80. It is noted that a process of the steps S73 to S79 is performed for each of the four cartridges 13 for storing ink of the four colors, i.e., black, magenta, cyan, and yellow.

The controller 51A determines whether there is a next page to be printed, based on the acquired print data (S80). When determining that there is a next page (S80: Yes), the controller 51A again performs S71 and the subsequent steps. When determining that there is no next page (S80: No), the controller 51A stores the post-printing remaining amount calculated in S75 into the IC memory 15 of each of the cartridges 13 attached to the attachment case 32 or into the EEPROM 57 (S81).

Further, the controller 51A generates management information (S82). The management information includes the printer identification information of the managed printer 10A, the number of sheets printed by the managed printer 10A, the post-printing remaining amount of each cartridge 13 in the managed printer 10A, ink low information representing whether the ink low flag for each cartridge 13 is set to "ON" or "OFF," and empty information representing whether the empty flag for each cartridge 13 is set to "ON" or "OFF." Then, the controller 51A transmits the generated management information to the information processing device 11 specified by the transmission address stored in the EEPROM 57 via the communication I/F 47 (S83). The controller 51A may transmit the management information each time the managed printer 10A performs printing, may transmit the management information at a regular time every day, or may transmit the management information at regular intervals such as every three hours or every six hours. Based on the transmission of the management information to the information processing device 11, the controller 51A terminates the print transmission process.

Figure 6A:
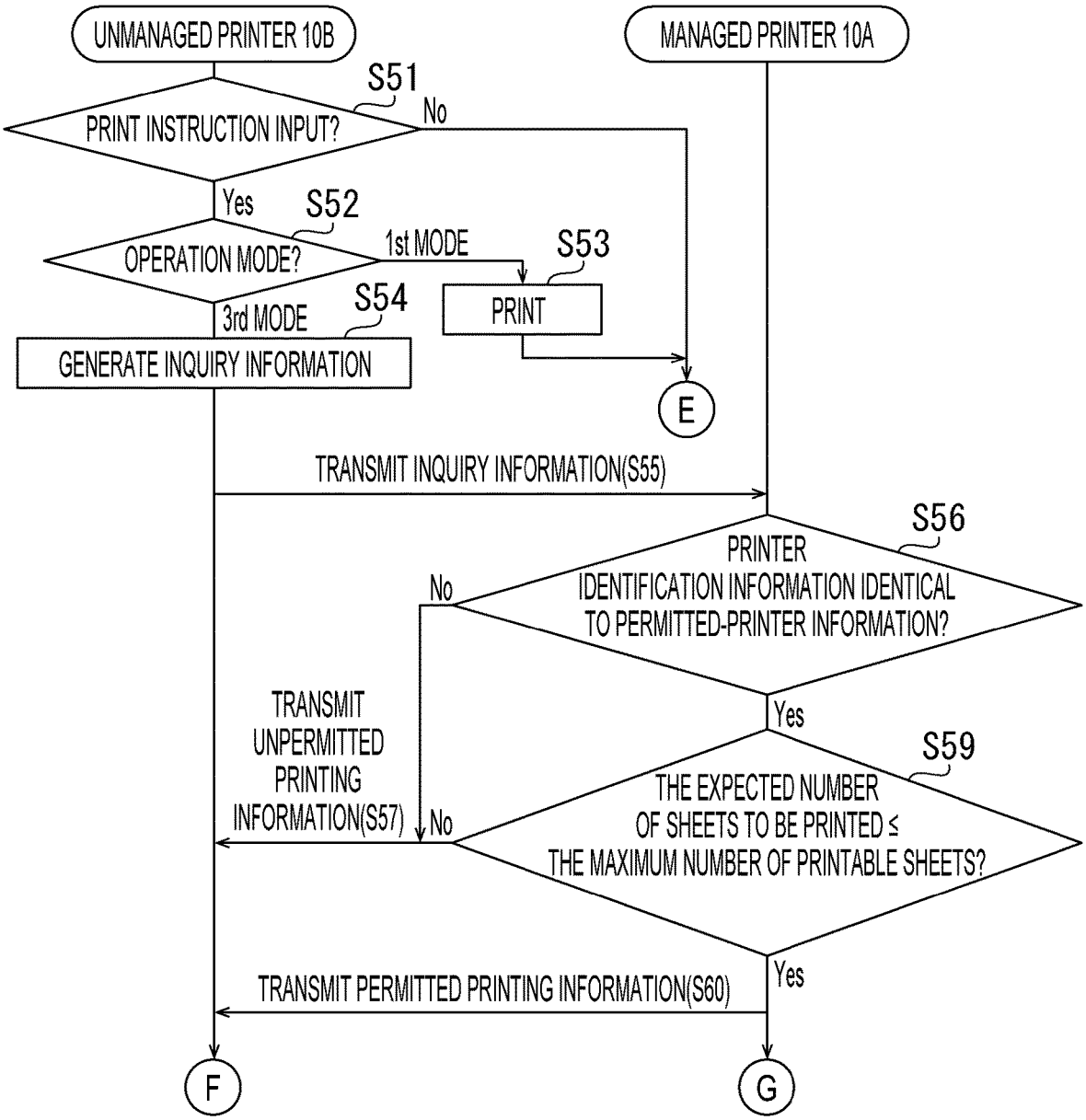
FIGS. 6A and 6B illustrate a procedure of a process to be performed when the unmanaged printer performs printing in a third mode, in the illustrative embodiment according to one or more aspects of the present disclosure.
Figure 6B:
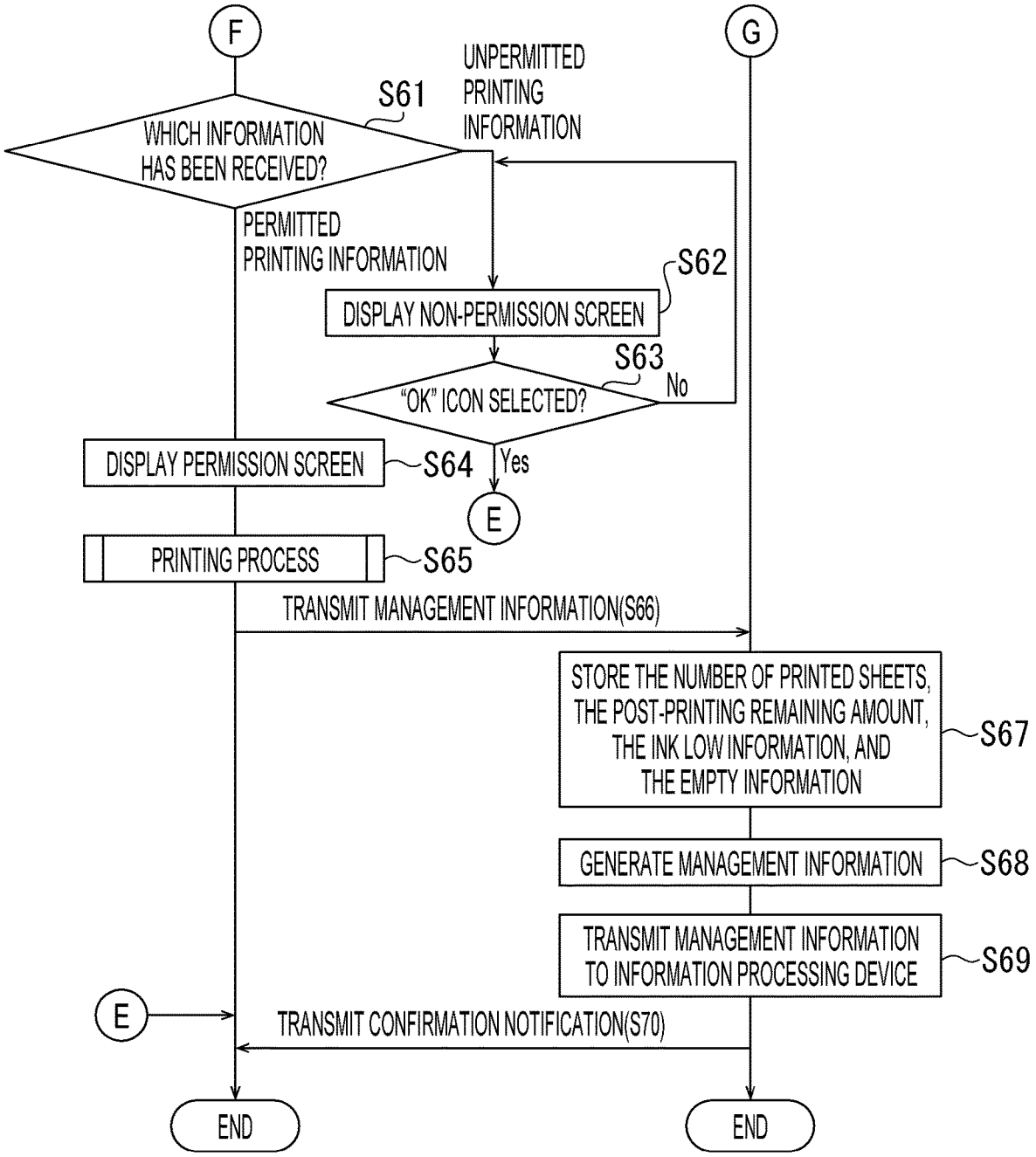

Next, referring to FIGS. 6A and 6B, an explanation will be provided of a process to be performed by the controller 51B when a print instruction is input to the unmanaged printer 10B. First, the controller 51B of the unmanaged printer 10B determines whether a print instruction and print data have been input (S51). For instance, the print instruction and the print data may be input to the unmanaged printer 10B from a personal computer via the communication I/F 47. In another instance, the print instruction may be input to the unmanaged printer 10B via the touch panel 42 or the operable switches 45. In this case, the print data may be input to the unmanaged printer 10B from a portable storage medium such as a USB memory attached to the unmanaged printer 10B.

When determining that the print instruction has not been input (S51: No), the controller 51B terminates the process. When determining that the print instruction and the print data have been input (S51: Yes), the controller 51B determines whether the operation mode for the unmanaged printer 10B is the first mode or the third mode (S52). Specifically, it is determined whether the first mode flag is set to "ON," or the third mode flag is set to "ON." When determining that the operation mode is the first mode (S52: First mode), the controller 51B performs a printing process (S53). Specifically, when determining that the operation mode is the first mode (S52: First mode), the controller 51B performs a process of the steps S71 to S81 in the print transmission process shown in FIG. 7. After S53, the controller 51B terminates the process.

When determining that the operation mode is the third mode (S52: Third mode), the controller 51B generates inquiry information (S54). Specifically, the controller 51B determines an expected number of sheets to be printed by the unmanaged printer 10B, based on the acquired print data. Then, the controller 51B generates the inquiry information including the expected number of sheets to be printed and the printer identification information of the unmanaged printer 10B. For instance, the controller 51B generates the inquiry information by appending the expected number of sheets to be printed and the printer identification information of the unmanaged printer 10B to a command for inquiring for permission for printing. The controller 51B transmits the generated inquiry information to the managed printer 10A identified by the IP address stored in the EEPROM 57 via the communication I/F 47 (S55).

The controller 51A of the managed printer 10A receives the inquiry information transmitted by the unmanaged printer 10B (S55). The controller 51A obtains the expected number of sheets to be printed and the printer identification information of the unmanaged printer 10B included in the received inquiry information. Then, the controller 51A determines whether the obtained printer identification information is identical to the permitted-printer information stored in the EEPROM 57 (S56). Namely, in S56, it is determined whether the received inquiry information is the inquiry information transmitted by the printer 10 permitted to perform printing. When determining that the printer identification information included in the inquiry information is not identical to the permitted-printer information stored in the EEPROM 57 (S56: No), the controller 51A transmits unpermitted printing information representing that the unmanaged printer 10B is not permitted to perform printing, to the unmanaged printer 10B via the communication I/F 47 (S57).

When determining that the printer identification information included in the inquiry information is identical to the permitted-printer information stored in the EEPROM 57 (S56: Yes), the controller 51A determines whether the expected number of sheets to be printed included in the received inquiry information is equal to or less than a maximum number of printable sheets (S59). Specifically, the EEPROM 57 of the memory 53 of the managed printer 10A stores the maximum number of printable sheets as an upper limit of the number of sheets printable within a particular period of time such as one day, one week, or one month. For instance, the maximum number of prints may be input to the managed printer 10A by the service provider via the touch panel 42 or the operable switches 45. In another instance, the maximum number of printable sheets may be input to the managed printer 10A from the information processing device 11 via the Internet. In this case, the maximum number of printable sheets transmitted by the information processing device 11 may be the maximum number of printable sheets registered on the management database 69 by an operator. The controller 51A of the managed printer 10A stores the input maximum number of printable sheets into the EEPROM 57. Although the following features are not shown in the flowchart, the controller 51A subtracts the expected number of sheets to be printed included in the inquiry information from the maximum number of printable sheets, each time the unmanaged printer 10B is given permission for printing. Then, the controller 51A determines whether the expected number of sheets to be printed included in the inquiry information is equal to or less than the maximum number of printable sheets stored in the EEPROM 57 (S59).

When determining that the expected number of sheets to be printed included in the inquiry information is more than the maximum number of printable sheets stored in the EEPROM 57 (S59: No), the controller 51A transmits the unpermitted printing information to the unmanaged printer 10B via the communication I/F 47, as a reply to the inquiry information (S57). When determining that the expected number of sheets to be printed included in the inquiry information is equal to or less than the maximum number of printable sheets stored in the EEPROM 57 (S59: Yes), the controller 51A transmits permitted printing information representing that the unmanaged printer 10B has been given permission for printing, to the unmanaged printer 10B via the communication I/F 47 (S60). Then, as described above, the controller 51A of the managed printer 10A subtracts the expected number of sheets to be printed by the unmanaged printer 10B, from the maximum number of printable sheets stored in the EEPROM 57 of the managed printer 10A.

The controller 51B of the unmanaged printer 10B receives the unpermitted printing information or the permitted printing information from the managed printer 10A via the communication I/F 47 (S57, S60). Then, the controller 51B determines which has been received of the unpermitted printing information and the permitted printing information (S61). When determining that the unpermitted printing information has been received (S61: Unpermitted Printing), the controller 51B controls the display panel 43 to display an unpermitted printing screen (not shown) (S62). For instance, the unpermitted printing screen includes an "OK" icon and a text "The expected number of sheets to be printed exceeds the upper limit. This printer cannot perform printing." The controller 51B causes the display panel 43 to display the unpermitted printing screen until the "OK" icon is selected on the unpermitted printing screen (S63: No). The controller 51B terminates the process without performing printing, in response to the "OK" icon being selected on the unpermitted printing screen (S63: Yes).

When determining in S61 that the permitted printing information has been received (S61: Permitted Printing), the controller 51B controls the display panel 43 to display a permitted printing screen (not shown) (S64). For instance, the permitted printing screen includes a text "This printer has been given permission for printing. The printer can perform printing." The controller 51B causes the display panel 43 to display the permitted printing screen, for instance, for a particular period of time or until the printing is completed. It is noted that the controller 51B may cause the display panel 43 to display the maximum number of printable sheets on the permitted printing screen. The maximum number of printable sheets is included in the permitted printing information received from the managed printer 10A.

While displaying the permitted printing screen on the display panel 43, the controller 51B performs a printing process (S65). The printing process will be described in detail with reference to FIG. 7 which shows the flowchart of the print transmission process by the controller 51A.

Figure 7:
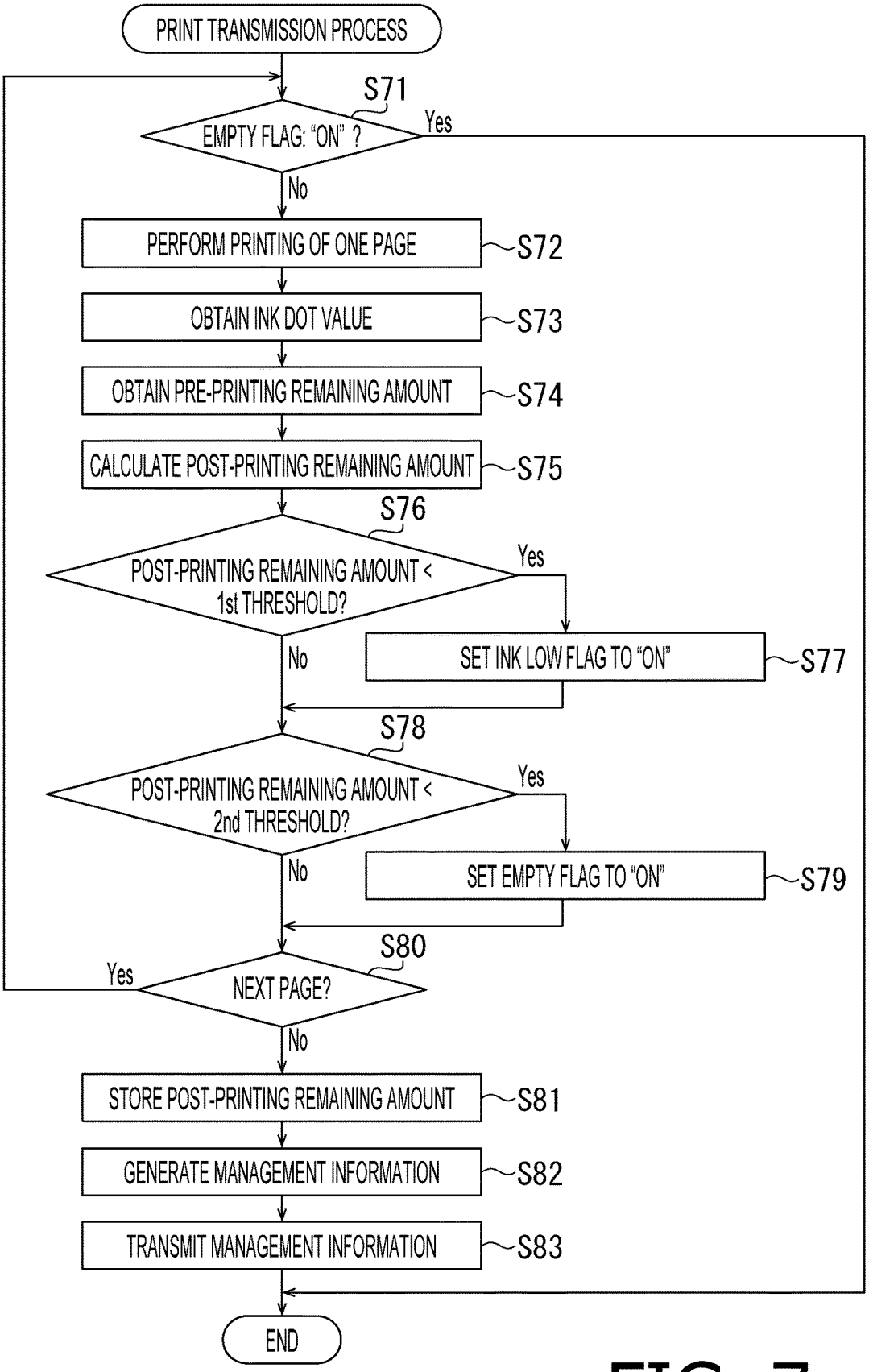
FIG. 7 is a flowchart showing a procedure of a print transmission process to be performed by the managed printer, in the illustrative embodiment according to one or more aspects of the present disclosure.

In the printing process, first, the controller 51B performs substantially the same process of S71 to S81 as shown in FIG. 7. Then, the controller 51B generates management information (S82). The management information includes the printer identification information of the unmanaged printer 10B, the number of printed sheets, post-printing remaining amount, ink low information, and empty information. Nonetheless, it is noted that the post-printing remaining amount represents a remaining amount of ink stored in a contractual use type cartridge 13 attached to the unmanaged printer 10B. Further, it is noted that the ink low information and the empty information are also for the contractual use type cartridge 13 attached to the unmanaged printer 10B. Namely, in S82, the controller 51B generates the management information regarding the contractual use type cartridge 13 attached to the unmanaged printer 10B. After completion of substantially the same process of S82 as shown in FIG. 7, the controller 51B terminates the printing process (S65) shown in FIG. 6B. It is noted that since the printing by the unmanaged printer 10B may be stopped, the number of printed sheets included in the management information may be different from the aforementioned expected number of sheets to be printed.

As shown in FIG. 6B, after completion of the printing process (S65), the controller 51B of the unmanaged printer 10B transmits the generated management information to the managed printer 10A identified by the IP address read out from the IC memory 15, via the communication I/F 47 (S66).

The controller 51A of the managed printer 10A receives the management information from the unmanaged printer 10B (S66). Then, the controller 51A stores the number of printed sheets, the post-printing remaining amount, the ink low information, and the empty information included in the received management information into the EEPROM 57 and/or the RAM 56 (S67). Then, the controller 51A generates management information (S68). The management information includes the printer identification information of the managed printer 10A, as well as the number of printed sheets, the post-printing remaining amount, the ink low information, and the empty information stored in the EEPROM 57 and/or the RAM 56. The controller 51A transmits the generated management information to the information processing device 11 identified by the transmission address (S69). Namely, the management information generated by the unmanaged printer 10B is transmitted from the managed printer 10A to the information processing device 11.

The controller 51A of the managed printer 10A transmits a confirmation notification representing that the management information has been received, to the unmanaged printer 10B as a reply to the management information transmitted by the unmanaged printer 10B (S70). Thereafter, the controller 51A terminates the process. On the other hand, the controller 51B of the unmanaged printer 10B terminates the process in response to receipt of the confirmation notification from the managed printer 10A (S70).

The following provides an explanation of a permission cancellation process (see FIG. 8) to be performed when a cartridge 13 is attached to the same place of the attachment case 32 as the cartridge 13 was removed from the managed printer 10A.

Figure 8:
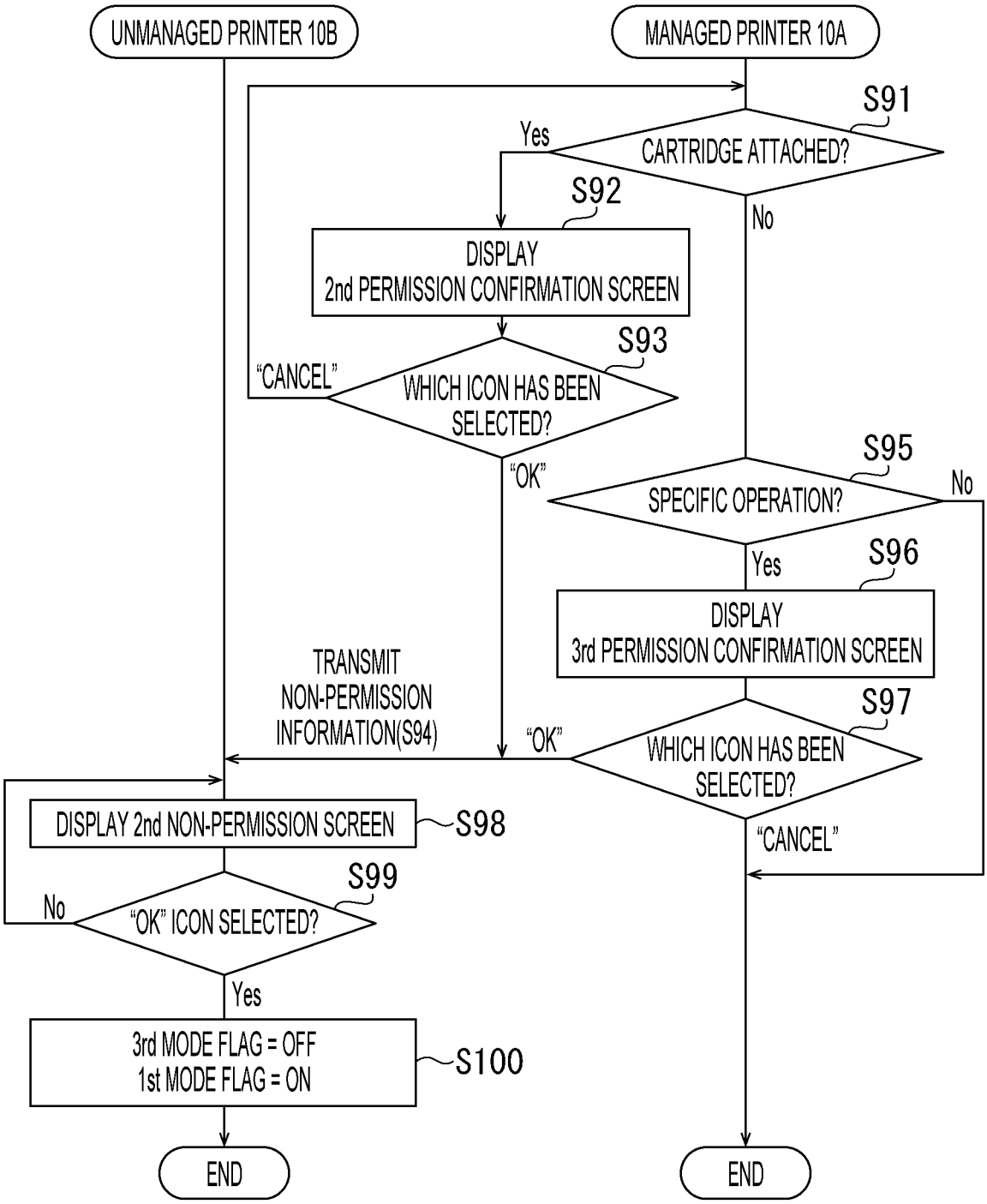
FIG. 8 illustrates a procedure of a permission cancellation process to be performed when a cartridge is attached to the same place as the cartridge was removed from the managed printer, in the illustrative embodiment according to one or more aspects of the present disclosure.

For instance, the controller 51A of the managed printer 10A periodically performs the permission cancellation process shown in FIG. 8. First, the controller 51A determines whether a cartridge 13 has been attached to the attachment case 32 of the managed printer 10A (S91). Specifically, the controller 51A determines whether the controller 51A is enabled to communicate with an IC memory 15 via the corresponding cartridge I/F 49. The controller 51A determines that a cartridge 13 has been attached to the attachment case 32 (S91: Yes) when the controller 51A is enabled to communicate with an IC memory 15 via the corresponding cartridge I/F 49. Meanwhile, the controller 51A determines that a cartridge 13 has not been attached to the attachment case 32 (S91: No) when the controller 51A is unable to communicate with an IC memory 15 via the corresponding cartridge I/F 49.

Figure 9B:
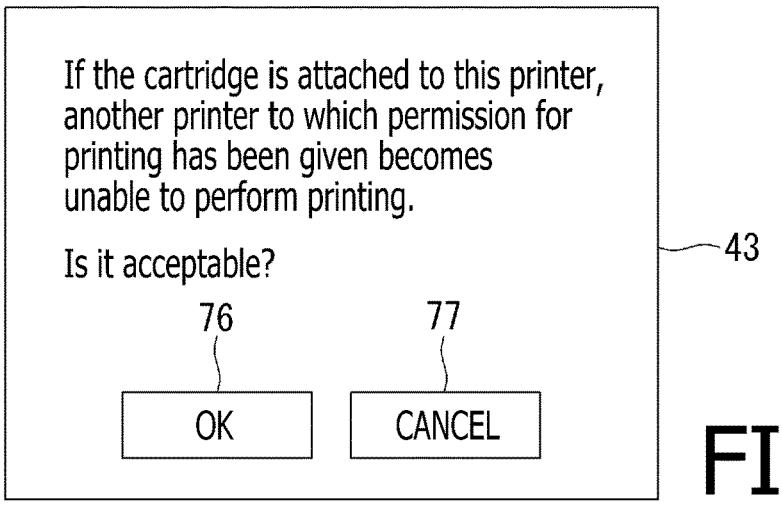
FIG. 9B shows an example of a second permission confirmation screen displayed on the display panel of the managed printer, in the illustrative embodiment according to one or more aspects of the present disclosure.

When determining that a cartridge 13 has been attached to the attachment case 32 of the managed printer 10A (S91: Yes), the controller 51A controls the display panel 43 to display a second permission confirmation screen (see FIG. 9B) (S92). Then, the controller 51A accepts selection of an "OK" icon 76 or a "Cancel" icon 77 on the second permission confirmation screen. For instance, when the user mistakenly attaches a cartridge 13 to the attachment case 32 of the managed printer 10A, the user removes the cartridge 13 from the attachment case 32 and selects the "Cancel" icon 77. Meanwhile, when the user attaches the cartridge 13 to the attachment case 32 of the managed printer 10A with the intention of terminating printing by the unmanaged printer 10B, the user selects the "OK" icon 76.

The controller 51A determines which has been selected by the user, of the "OK" icon 76 and the "Cancel" icon 77 (S93). When determining that the selected icon is the "Cancel" icon 77 (S93: Cancel), the controller 51A goes back to S91. When determining that the selected icon is the "OK" icon 76 (S93: OK), the controller 51A transmits the non-permission information to the unmanaged printer 10B via the communication I/F 47 (S94).

Figure 10C:
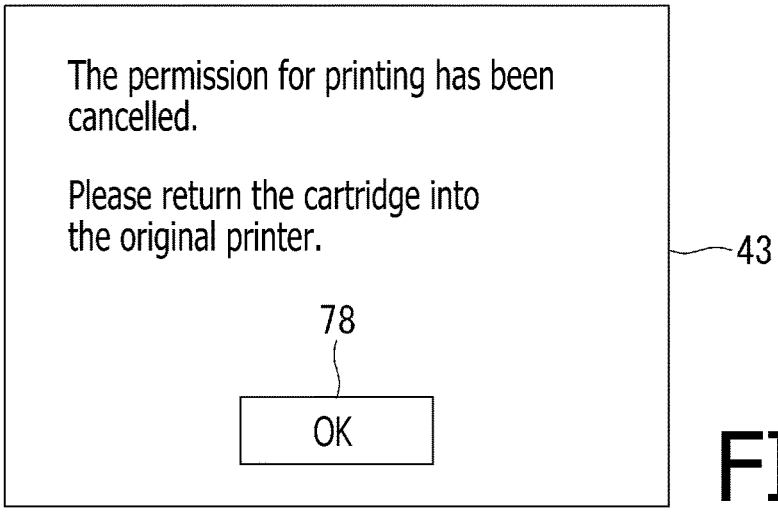
FIG. 10C shows an example of a second non-permission screen displayed on the display panel of the unmanaged printer, in the illustrative embodiment according to one or more aspects of the present disclosure.

When receiving the non-permission information (S94), the controller 51B of the unmanaged printer 10B controls the display panel 43 to display a second non-permission screen (S98). FIG. 10C shows an example of the second non-permission screen. The second non-permission screen includes an "OK" icon 78 and a text "The permission for printing has been cancelled. Please return the cartridge into the original printer." The controller 51B causes the display panel 43 to display the second non-permission screen until the "OK" icon 78 is selected on the second non-permission screen (S99: No). When determining that the "OK" icon 78 has been selected on the second non-permission screen (S99: Yes), the controller 51B sets the third mode flag to "OFF" and sets the first mode flag to "ON" (S100). Afterward, the controller 51B terminates the permission cancellation process.

When determining in S91 that a cartridge 13 has not been attached to the attachment case 32 of the managed printer 10A (S91: No), the controller 51A determines whether or not a specific operation has been input via the touch panel 42 or the operable switches 45. (S95). The specific operation is, for example, an operation for selecting a specific icon displayed on the display panel 43 and for cancelling the permission for printing to the unmanaged printer 10B. When determining that the specific operation has not been input (S95: No), the controller 51A terminates the permission cancellation process. When determining that the specific operation has been input (S95: Yes), the controller 51A controls the display panel 43 to display a third permission confirmation screen (S96).

Figure 9C:
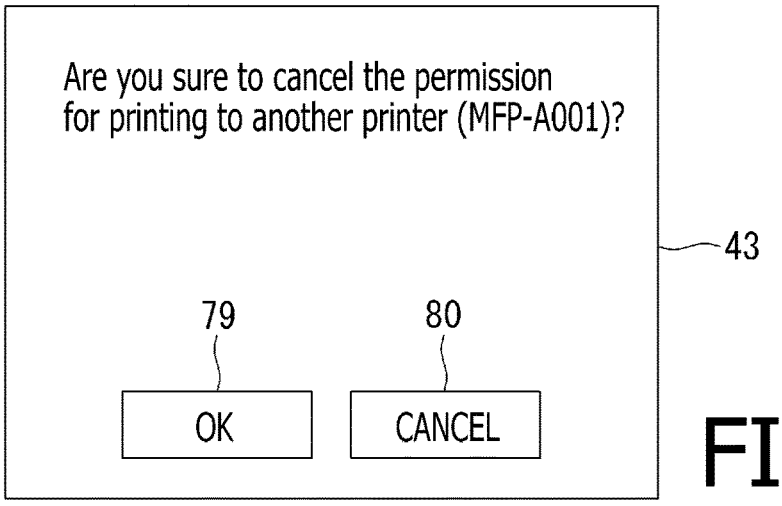
FIG. 9C shows an example of a third permission confirmation screen displayed on the display panel of the managed printer, in the illustrative embodiment according to one or more aspects of the present disclosure.

FIG. 9C shows an example of the third permission confirmation screen. The third permission confirmation screen includes an "OK" icon 79, a "Cancel" icon 80, and a text "Are you sure to cancel the permission for printing to another printer (MFP-A001)?" The controller 51A causes the display panel 43 to continuously display the third permission confirmation screen until the user selects an icon. For instance, when the erroneously inputs the specific operation to the managed printer 10A, the user selects the "Cancel" icon 80. When the user inputs the specific operation to the managed printer 10A with the intention of cancelling the permission for printing to the unmanaged printer 10B, the user selects the "OK" icon 79. When determining that the "OK" icon 79 has been selected on the third permission confirmation screen (S97: OK), the controller 51A transmits the non-permission information to the unmanaged printer 10B, as described above (S94). When determining that the "Cancel" icon 80 has been selected on the third permission confirmation screen (S97: Cancel), the controller 51A terminates the process.

[Operations and Advantageous Effects of Illustrative Embodiment]

When determining that the permission application information transmitted by the unmanaged printer 10B includes a MAC address identical to the MAC address stored in the EEPROM 57 of the memory 53 (S33: Yes), the controller 51A of the managed printer 10A transmits, to the unmanaged printer 10B, the permission information for permitting the unmanaged printer 10B to perform printing. Thus, the managed printer 10A may permit the unmanaged printer 10B to temporarily use the contractual use type cartridge 13 that had been attached to the managed printer 10A.

Further, the controller 51 of each printer 10 determines its own operation mode to be the first mode when the controller 51 has not obtained the type information representing the contractual use type from the IC memory 15 of any of the cartridges 13 attached to the attachment case 32. Meanwhile, the controller 51 of each printer 10 determines its own operation mode to be the second mode when the controller 51 has obtained the type information representing the contractual use type from the IC memories 15 of all of the cartridges 13 attached to the attachment case 32. Namely, each printer 10 is configured to operate with the contractual use type cartridges 13 attached and operate with the normal use type cartridges 13 attached. Accordingly, each printer 10 may be used as the managed printer 10A for which the user has signed a contract with the service provider, or may be used as the unmanaged printer 10B for which the user has not signed a contract with the service provider.

Further, the controller 51A of the managed printer 10A transmits the permission information to the unmanaged printer 10B when determining that the "Permission" icon 71 has been selected on the first permission confirmation screen (see FIG. 9A) (S38). Therefore, it is possible to prevent the user from mistakenly attaching to the unmanaged printer 10B the contractual use type cartridge 13 that had been attached to the managed printer 10A.

The controller 51A of the managed printer 10A receives the management information from the unmanaged printer 10B. Therefore, the managed printer 10A is enabled to obtain information regarding the amount of ink remaining in the contractual use type cartridge 13 that had been attached to the managed printer 10A and the number of sheets printed with the contractual use type cartridge 13 that had been attached to the managed printer 10A.

Further, the controller 51A of the managed printer 10A transmits the management information to the information processing device 11. Therefore, the service provider is enabled to obtain the information regarding the amount of ink remaining in the contractual use type cartridge 13 that had been attached to the managed printer 10A and the number of sheets printed with the contractual use type cartridge 13 that had been attached to the managed printer 10A. The service provider is enabled to arrange for delivery of a new cartridge 13 based on the information regarding the amount of ink remaining in the cartridge 13. Further, the service provider is enabled to determine an amount of money to be charged to the user based on the obtained number of printed sheets. Thus, the managed printer 10A may permit the unmanaged printer 10B to temporarily use the contractual use type cartridge 13 that had been attached to the managed printer 10A. Further, even when the managed printer 10A has permitted the unmanaged printer 10B to temporarily use the contractual use type cartridge 13 that had been attached to the managed printer 10A, the managed printer 10A may prompt the service provider to arrange for the delivery of a new cartridge 13 and determine the amount of money to be charged to the user.

Further, the controller 51A of the managed printer 10A determines whether to permit the unmanaged printer 10B to perform printing, based on the maximum number of sheets printable by the managed printer 10A and the expected number of sheets to be printed by the unmanaged printer 10B (S56). Accordingly, the managed printer 10A is enabled to prevent the unmanaged printer 10B from performing printing for sheets more than the maximum number of sheets printable by the managed printer 10A.

Further, when determining that a cartridge 13 has been attached to the attachment case 32 of the managed printer 10A (S91: Yes), the controller 51A transmits the non-permission information to the unmanaged printer 10B (S94). Thus, it is possible to prevent such an unfavorable situation as the service provider is unable to manage the amount of ink remaining in the contractual use type cartridge 13 used in both in both the managed printer 10A and the unmanaged printer 10B.

Further, the controller 51A of the managed printer 10A controls the display panel 43 to display the second permission confirmation screen (see FIG. 9B) (S92) when a cartridge 13 has been attached to the attachment case 32 (S91: Yes). Then, when determining that the "OK" icon 76 has been selected on the second permission confirmation screen (S93: OK), the controller 51A transmits the non-permission information to the unmanaged printer 10B. Meanwhile, when determining that the "Cancel" icon 77 has been selected on the second permission confirmation screen (S93: Cancel), the controller 51A again determines whether a cartridge 13 has been attached to the attachment case 32 of the managed printer 10A (S91). Therefore, even though the user mistakenly attaches a cartridge 13 to the attachment case 32 of the managed printer 10A, it is possible to prevent the unmanaged printer 10B from being immediately unable to perform printing.

Further, the controller 51B of the unmanaged printer 10B obtains the MAC address of the managed printer 10A from the IC memory 15 of the contractual use type cartridge 13 attached to the attachment case 32 of the unmanaged printer 10B. Then, the controller 51B transmits the permission application information including the obtained MAC address, thereby being given permission for printing by the managed printer 10A. Therefore, even though the unmanaged printer 10B runs out of ink in a cartridge 13 attached thereto, the unmanaged printer 10B is permitted to perform printing when the contractual use type cartridge 13, which had been attached to the managed printer 10A, is temporarily attached to the unmanaged printer 10B.

Further, the controller 51B of the unmanaged printer 10B controls the display panel 43 to display the permission screen (see FIG. 10A) representing that the unmanaged printer 10B has been given permission for printing or a first non-permission screen (see FIG. 10B) representing that the unmanaged printer 10B has not been given permission for printing. Thus, the unmanaged printer 10B makes it possible for the user to recognize whether the unmanaged printer 10B is permitted to perform printing.

Further, the controller 51B of the unmanaged printer 10B transmits the management information to the managed printer 10A. Thus, the unmanaged printer 10B is enabled to notify the managed printer 10A of the amount of ink remaining in the cartridge 13 and the number of printed sheets.

Further, the controller 51B of the unmanaged printer 10B transmits, to the managed printer 10A, the inquiry information including the expected number of sheets to be printed by the unmanaged printer 10B. Thus, the unmanaged printer 10B is enabled to prevent the unmanaged printer 10B itself from performing printing for sheets more than the maximum number of printable sheets determined in the managed printer 10A.

Hereinabove, the illustrative embodiment according to aspects of the present disclosure has been described. Aspects of the present disclosure may be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications according to aspects of the present disclosure are feasible.

[First Modification]

Figure 12A:
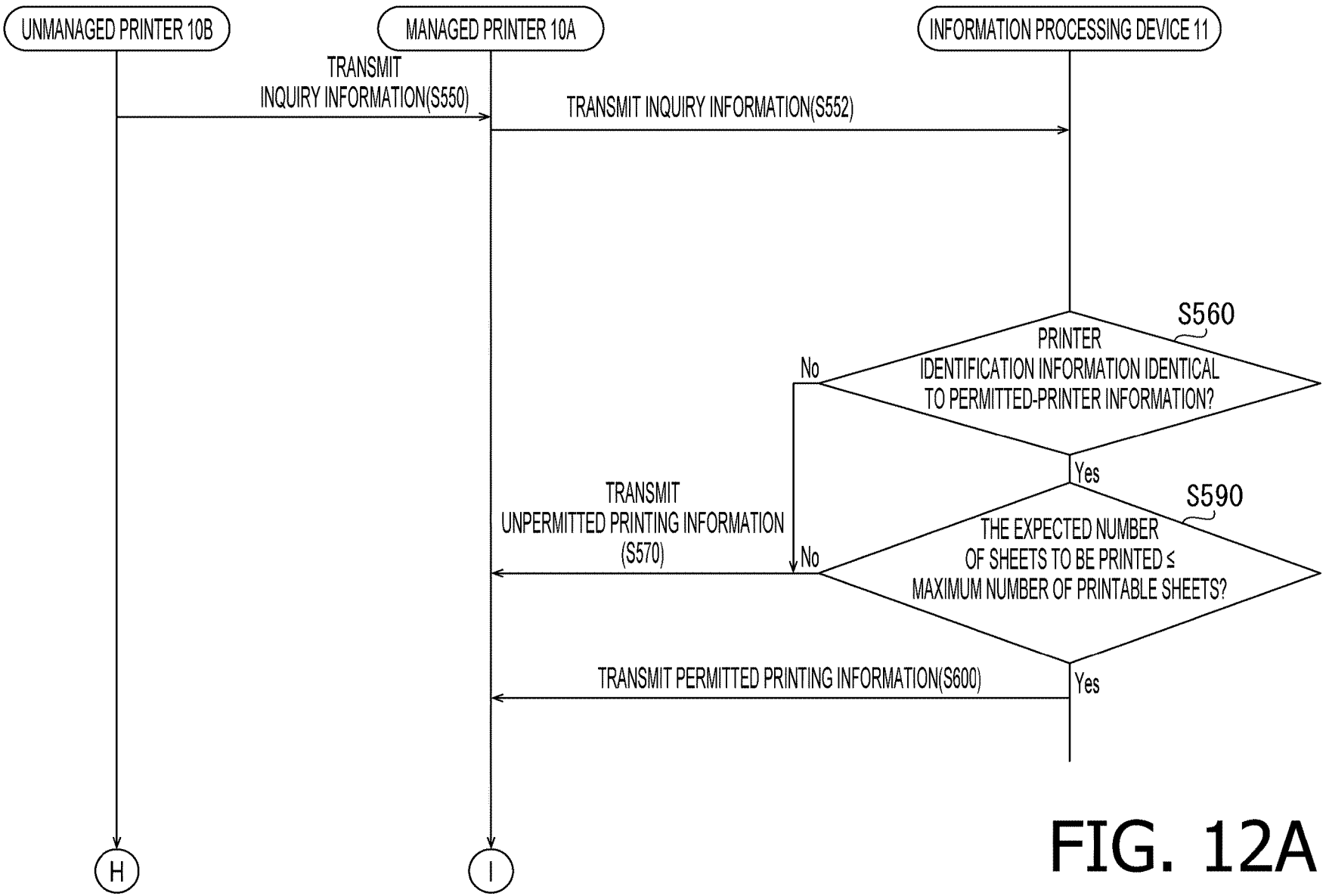
FIGS. 12A and 12B illustrate a process of S550 to S610 executable instead of a process of S55 to S61 shown in FIGS. 6A and 6B, in a first modification according to one or more aspects of the present disclosure.
Figure 12B:
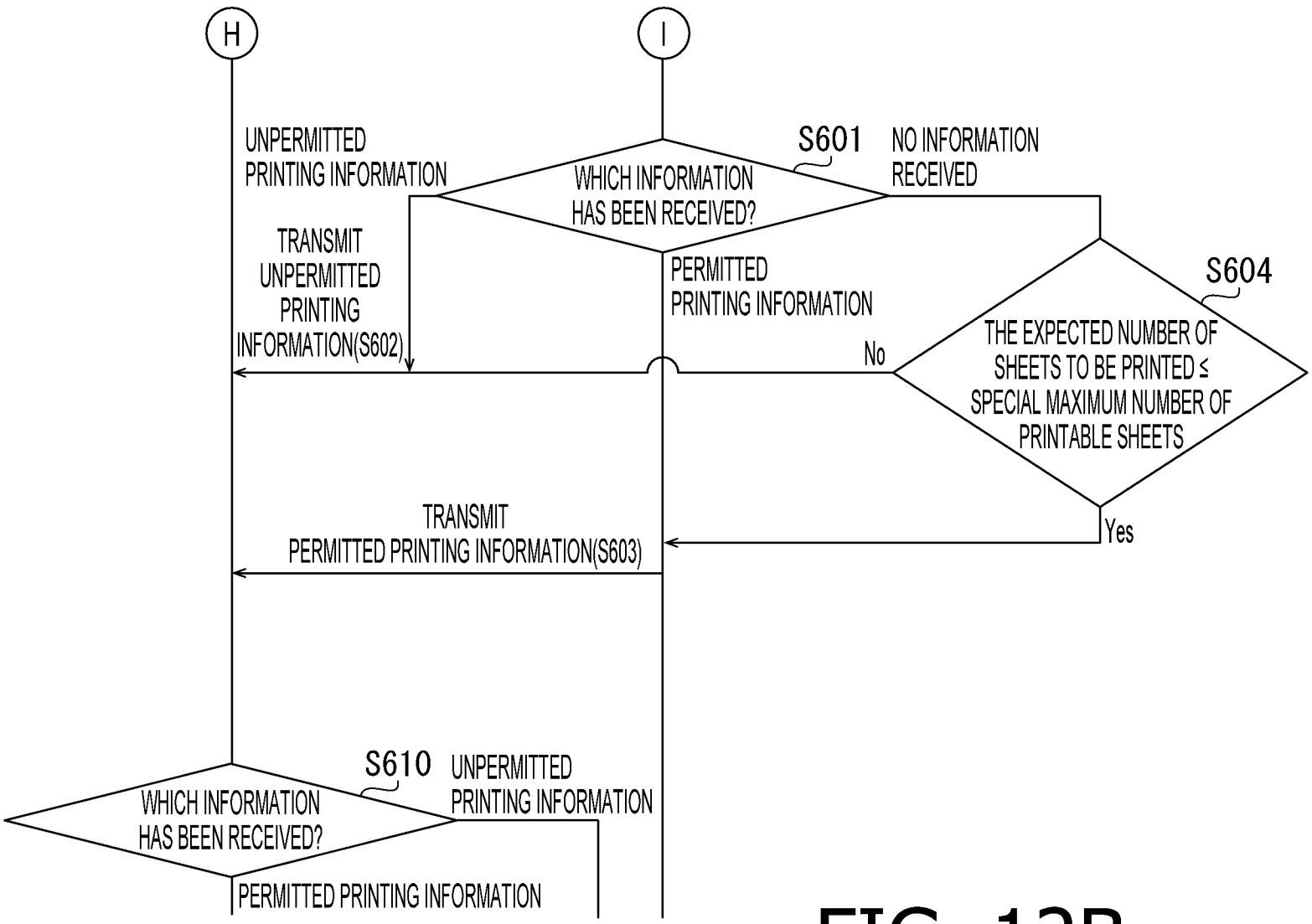

In the aforementioned illustrative embodiment, an example has been described in which the maximum number of printable sheets is stored in the EEPROM 57 of the memory 53 of the management printer 10A. More specifically, in the above-described example, the controller 51A determines whether to give the unmanaged printer 10B permission for printing, based on the expected number of sheets to be printed included in the inquiry information and the maximum number of printable sheets stored in the EEPROM 57. Nonetheless, the information processing device 11 may determine whether to give the unmanaged printer 10B permission for printing. In this case, for instance, a process of S55 to S61 shown in FIGS. 6A and 6B may be replaced with a process of S550 to S610 shown in FIGS. 12A and 12B. Specifically, after receiving the inquiry information from the unmanaged printer 10B (S550), the controller 51A of the managed printer 10A transmits inquiry information including the expected number of sheets to be printed included in the received inquiry information, to the information processing device 11 via the communication I/F 47 (S552).

When receiving the inquiry information (S552), the controller 61 of the information processing device 11 determines whether the expected number of sheets to be printed included in the inquiry information is equal to or less than the maximum number of printable sheets registered on the management database 69 (S560). When determining that the expected number of sheets to be printed is equal to or less than the maximum number of printable sheets (S560: Yes), the controller 61 transmits the permitted printing information to the managed printer 10A (S600). Meanwhile, when determining that the expected number of sheets to be printed is more than the maximum number of printable sheets (S560: No), the controller 61 transmits the unpermitted printing information to the managed printer 10A (S570).

When determining that the permitted printing information has been received (S601: Permitted Printing Information), the controller 51A of the managed printer 10A transmits the permitted printing information to the unmanaged printer 10B via the communication I/F 47 (S603). Meanwhile, when determining that the unpermitted printing information has been received (S601: Unpermitted Printing Information), the controller 51A transmits the unpermitted printing information to the unmanaged printer 10B via the communication I/F 47 (S602).

When the connection between the Internet 12 and the local network to which the managed printer 10A is connected is disconnected, or when the connection between the information processing device 11 and the Internet 12 is disconnected, the controller 51A of the managed printer 10A is unable to receive a reply from the information processing device 11. When determining that the controller 51A has been unable to receive a reply from the information processing device 11 in any re-attempt of a predetermined number of re-attempts specified by a communication protocol (S601: No Information Received), the controller 51A determines whether the obtained expected number of sheets to be printed is equal to or less than a special maximum number of printable sheets stored in the EEPROM 57 (S604). For instance, the special maximum number of printable sheets is a value previously stored in the EEPROM 57 as the number of sheets printable when the controller 51A is unable to communicate with the information processing device 11. For instance, the special maximum number of printable sheets is five.

When determining that the expected number of sheets to be printed is equal to or less than the special maximum number of printable sheets (S604: Yes), the controller 51A of the managed printer 10A transmits the permitted printing information to the unmanaged printer 10B via the communication I/F 47 (S603). Meanwhile, when determining that the expected number of sheets to be printed is more than the special maximum number of printable sheets (S604: No), the controller 51A transmits the unpermitted printing information to the unmanaged printer 10B via the communication I/F 47 (S602). Then, the controller 51B of the unmanaged printer 10B performs substantially the same process as in S61 of FIG. 6B (S610).

In the first modification as well, the managed printer 10A may prevent the unmanaged printer 10B from performing printing for sheets more than the maximum number of printable sheets set for the managed printer 10A.

Further, even when the managed printer 10A is unable to communicate with the information processing device 11, the managed printer 10A may permit the unmanaged printer 10B to perform printing for sheets of a number up to the special maximum number of printable sheets.

[Second Modification]

In the aforementioned illustrative embodiment, an example has been described in which the MAC address of the managed printer 10A is stored in the IC memory 15 of each cartridge 13 attached to the attachment case 32 of the managed printer 10A. However, the CTG serial number of each cartridge 13 attached to the attachment case 32 of the managed printer 10A may be stored in the EEPROM 57 of the memory 53 of the managed printer 10A. In this case, the controller 51A of the managed printer 10A reads the CTG serial number from the IC memory 15 of each cartridge 13 attached to the attachment case 32, and stores the read CTG serial number into the EEPROM 57. It is noted that the cartridge identification information is not limited to the CTG serial number but may be any type of information as long as the information makes it possible to identify an individual cartridge 13.

When a contractual use type cartridge 13 removed from the managed printer 10A is attached to the attachment case 32 of the unmanaged printer 10B, the controller 51B of the unmanaged printer 10B reads out the IP address and the CTG serial number from the IC memory 15 of the cartridge 13 attached to the attachment case 32. Then, the controller 51B transmits the permission application information including the read CTG serial number to the managed printer 10A identified by the read IP address (S32).

The controller 51A of the managed printer 10A transmits the permission information to the unmanaged printer 10B based on the CTG serial number included in the received permission application information is identical to the CTG serial number stored in the EEPROM 57 (S38).

In the second modification as well, the managed printer 10A may permit the unmanaged printer 10B to temporarily use the contractual use type cartridge 13 that had been attached to the managed printer 10A. Further, even though the unmanaged printer 10B runs out of ink in a cartridge 13 attached thereto, the unmanaged printer 10B is permitted to perform printing when the contractual use type cartridge 13, which had been attached to the managed printer 10A, is temporarily attached to the unmanaged printer 10B.

[Other Modifications]

In the aforementioned illustrative embodiment, an example has been described in which the information processing device 11 is a server. Nonetheless, the information processing device 11 may be a personal computer or a mobile terminal connected with the Internet 12. In this case, the managed printer 10A stores an email address of the information processing device 11 in the EEPROM 57 as the transmission address. Then, the managed printer 10A transmits the management information to the email address.

In the aforementioned illustrative embodiment, an example has been described in which the managed printer 10A and the unmanaged printer 10B have the same specifications, and each of the printers 10 is usable as the managed printer 10A or as the unmanaged printer 10B. Nonetheless, the management printer 10A and the unmanaged printer 10B may have different specifications. Specifically, the managed printer 10A may be configured to operate only in the second mode. Further, the unmanaged printer 10B may be configured to operate only in the first mode or the third mode.

In the aforementioned illustrative embodiment, an example has been described in which the type information is stored in the IC memory 15 of each cartridge 13. Nonetheless, a cartridge 13 of which the IC memory 15 does not have the type information stored therein may be attached to a printer 10. When the controller 51 is unable to read out the type information from the IC memory 15 of a cartridge 13 attached to the attachment case 32 in the operation mode determination process (see FIGS. 4A and 4B), the controller 51 may determine that the attached cartridge 13 is of the normal use type.

In the aforementioned illustrative embodiment, an example has been described in which the controller 51A of the managed printer 10A stores its own MAC address and its own IP address in the IC memory 15 of each cartridge 13 attached to the attachment case 32 of the managed printer 10A. Nonetheless, the controller 51A may store only the MAC address in the IC memory 15. In this case, the controller 51B of the unmanaged printer 10B broadcasts the permission application information including the MAC address of the managed printer 10A to the local network. A node connected with the local network discards the broadcasted permission application information when the permission application information does not include a MAC address of the node. Then, the controller 51B of the unmanaged printer 10B performs the process shown in FIG. 5 when determining that the MAC address of the unmanaged printer 10B is included in the broadcasted permission application information. Then, the controller 51A of the managed printer 10A incorporates the IP address of the managed printer 10A into the permission information to be transmitted to the unmanaged printer 10B. The controller 51B of the unmanaged printer 10B stores the IP address included in the permission information into the EEPROM 57 of the memory 53. The controller 51B transmits the inquiry information to the managed printer 10A using the IP address stored in the EEPROM 57.

In the aforementioned illustrative embodiment, an example has been described in which the permission confirmation screens (see FIGS. 9A to 9C) are displayed on the display panel 43 of the managed printer 10A. Nonetheless, the permission confirmation screens may be displayed on a display of a mobile terminal or a personal computer. The personal computer is connected with the aforementioned local network communicably with the managed printer 10A. The mobile terminal is a terminal device having a wireless communication function, such as a mobile phone or a tablet computer. The mobile terminal is configured to communicate with the managed printer 10A through an access point on the local network. The managed printer 10A transmits image data representing the permission confirmation screen to the personal computer or the mobile terminal. The personal computer or the mobile terminal transmits, to the managed printer 10A, information representing an icon selected by the user on the permission confirmation screen. Similarly, the permission screen and the non-permission screens (see FIGS. 10A to 10C) may be displayed on the display of the mobile terminal or the personal computer.

The following shows examples of associations between elements exemplified in the aforementioned illustrative embodiment and modifications and elements according to aspects of the present disclosure. The managed printer 10A and the unmanaged printer 10B may be included in examples of an "image recording apparatus" according to aspects of the present disclosure. The managed printer 10A may be an example of a "permission-giving image recording apparatus" according to aspects of the present disclosure. The managed printer 10A may be an example of a "first image recording apparatus" according to aspects of the present disclosure. The unmanaged printer 10B may be an example of a "permission-requesting image recording apparatus" according to aspects of the present disclosure. The unmanaged printer 10B may be an example of a "second image recording apparatus" according to aspects of the present disclosure. The communication system 100 including the managed printer 10A and the unmanaged printer 10B interconnected via the local network may be an example of a "communication system" according to aspects of the present disclosure. The display panel 43 may be an example of a "display panel" according to aspects of the present disclosure. The touch sensor 44 and the operable switches 45 may be included in examples of a "user interface" according to aspects of the present disclosure. The attachment case 32 may be an example of an "attachment case" according to aspects of the present disclosure. The attachment case 32 of the managed printer 10A may be an example of a "first attachment case" according to aspects of the present disclosure. The attachment case 32 of the unmanaged printer 10B may be an example of a "second attachment case" according to aspects of the present disclosure. The cartridge I/F 49 of the managed printer 10A may be an example of a "first cartridge interface" according to aspects of the present disclosure. The cartridge I/F 49 of the unmanaged printer 10B may be an example of a "second cartridge interface" according to aspects of the present disclosure. The type information representing the contractual use type may be an example of "specific information" according to aspects of the present disclosure. The IC memory 15 may be an example of a "cartridge memory" according to aspects of the present disclosure. The MAC address stored in the IC memory 15 may be an example of "apparatus identification information" according to aspects of the present disclosure. The print engine 40 may be an example of a "print engine" according to aspects of the present disclosure. The print engine 40 of the managed printer 10A may be an example of a "first print engine" according to aspects of the present disclosure. The print engine 40 of the unmanaged printer 10B may be an example of a "second print engine" according to aspects of the present disclosure. The communication I/F 47 may be an example of a "communication interface" according to aspects of the present disclosure. The communication I/F 47 of the managed printer 10A may be an example of a "first communication interface" according to aspects of the present disclosure. The communication I/F 47 of the unmanaged printer 10B may be an example of a "second communication interface" according to aspects of the present disclosure. The memory 53 may be an example of a "memory" according to aspects of the present disclosure. The memory 53 of the managed printer 10A may be an example of a "first memory" according to aspects of the present disclosure. The memory 53 of the unmanaged printer 10B may be an example of a "second memory" according to aspects of the present disclosure. The ROM 55 may be an example of a "non-transitory computer-readable medium" according to aspects of the present disclosure. The CPU 52 may be an example of a "processor" according to aspects of the present disclosure. The control program 59 may be an example of "computer-readable instructions" according to aspects of the present disclosure. The controller 51 may be an example of a "controller" according to aspects of the present disclosure. The controller 51 of the managed printer 10A may be an example of a "first controller" according to aspects of the present disclosure. The controller 51 of the unmanaged printer 10B may be an example of a "second controller" according to aspects of the present disclosure. The management information may be an example of "print information" according to aspects of the present disclosure. The CTG serial number may be an example of "cartridge identification information" according to aspects of the present disclosure.

What is claimed is:

1. An image recording apparatus comprising:

an attachment case configured to receive a cartridge removably attached thereto, the cartridge having a cartridge memory;

a print engine configured to perform printing on a sheet;

a cartridge interface;

a communication interface; and a controller having a memory, the controller being configured to:

store apparatus identification information stored in the memory, into the cartridge memory via the cartridge interface, the apparatus identification information identifying the image recording apparatus;

receive permission application information from another image recording apparatus via the communication interface, the permission application information including reception identification information for identifying the another image recording apparatus;

determine whether or not the reception identification information included in the received permission application information is identical to the apparatus identification information stored in the memory; and transmit permission information to the another image recording apparatus via the communication interface, when determining that the cartridge has been removed from the attachment case and determining that the reception identification information is identical to the apparatus identification information, the permission information representing that the another image recording apparatus is permitted to perform printing using the cartridge removed from the image recording apparatus.

2. The image recording apparatus according to claim 1, wherein the controller is further configured to:

set an operation mode to a first mode, when having not obtained specific information from the cartridge memory via the cartridge interface;

set the operation mode to a second mode, when having obtained the specific information from the cartridge memory via the cartridge interface; and transmit the permission information to the another image recording apparatus via the communication interface, when the operation mode is set to the second mode.

3. The image recording apparatus according to claim 1, further comprising:

a display panel; and a user interface, wherein the controller is further configured to:

when receiving the permission application information, control the display panel to display a permission confirmation screen;

while the permission confirmation screen is being displayed, receive, via the user interface, a permission operation for permitting the another image recording apparatus to perform printing; and when receiving the permission operation, transmit the permission information to the another image recording apparatus via the communication interface.

4. The image recording apparatus according to claim 1, wherein the controller is further configured to:

receive print information from the another image recording apparatus via the communication interface, the print information containing information on printing to be performed by the another image recording apparatus.

5. The image recording apparatus according to claim 4, the controller is further configured to:

generate management information based on the received print information; and transmit the generated management information to an information processing device on an Internet, via the communication interface.

6. The image recording apparatus according to claim 1, wherein the controller is further configured to:

receive inquiry information from the another image recording apparatus via the communication interface, the inquiry information inquiring as to whether the another image recording apparatus is permitted to perform printing for an expected number of sheets to be printed;

determine whether to give permission for printing to the another image recording apparatus, based on the expected number of sheets to be printed included in the received inquiry information and a maximum number of printable sheets stored in the memory; and when determining to give the permission for printing to the another image recording apparatus, transmit permitted printing information to the another image recording apparatus via the communication interface.

7. The image recording apparatus according to claim 1, wherein the controller is further configured to:

receive first inquiry information from the another image recording apparatus via the communication interface, the inquiry information inquiring about whether the another image recording apparatus is permitted to perform printing for an expected number of sheets to be printed;

transmit second inquiry information including the expected number of sheets to be printed, to an information processing device on an Internet via the communication interface;

receive reply information from the information processing device via the communication interface, the reply information representing whether the another image recording apparatus is permitted to perform printing for the expected number of sheets to be printed; and transmit permitted printing information to the another image recording apparatus via the communication interface, when the received reply information represents that the another image recording apparatus is permitted to perform printing for the expected number of sheets to be printed.

8. The image recording apparatus according to claim 7, wherein the controller is further configured to:

determine whether the image recording apparatus is communicable with the information processing device via the communication interface;

when determining that the image recording apparatus is communicable with the information processing device via the communication interface, receive the reply information from the information processing device via the communication interface, and transmit the permitted printing information to the another image recording apparatus via the communication interface when the received reply information represents that the another image recording apparatus is permitted to perform printing for the expected number of sheets to be printed;

when determining that the image recording apparatus is not communicable with the information processing device via the communication interface, determine whether to give permission for printing to the another image recording apparatus, based on the expected number of sheets to be printed included in the received first inquiry information and special maximum number of printable sheets stored in the memory; and when determining to give the permission for printing to the another image recording apparatus, transmit the permitted printing information to the another image recording apparatus via the communication interface.

9. The image recording apparatus according to claim 1, wherein the controller is further configured to:

when determining that the cartridge has been attached to the attachment case after transmission of the permission information to the another image recording apparatus, transmit non-permission information to the another image recording apparatus via the communication interface, the non-permission information representing that the another image recording apparatus is not permitted to perform printing.

10. The image recording apparatus according to claim 9, further comprising a display panel and a user interface, wherein the controller is further configured to:

when determining that the cartridge has been attached to the attachment case after transmission of the permission information to the another image recording apparatus, control the display panel to display a permission confirmation screen;

while the permission confirmation screen is being displayed, receive, via the user interface, a non-permission operation for not permitting the another image recording apparatus to perform printing; and when receiving the non-permission operation, transmit the non-permission information to the another image recording apparatus via the communication interface.

11. An image recording apparatus comprising:

an attachment case configured to receive a cartridge removably attached thereto, the cartridge having a cartridge memory;

a print engine configured to perform printing on a sheet;

a cartridge interface;

a communication interface; and a controller having a memory, the controller being configured to:

determine whether or not the controller has obtained, from the cartridge memory of the cartridge attached to the attachment case via the cartridge interface, apparatus identification information representing a permission-giving image recording apparatus, the apparatus identification information identifying the permission-giving image recording apparatus;

when determining that the controller has obtained the apparatus identification information, transmit permission application information including the apparatus identification information to the permission-giving image recording apparatus via the communication interface, the permission application information including reception identification information for identifying the image recording apparatus;

receive permission information from the permission-giving image recording apparatus via the communication interface, the permission information representing that the image recording apparatus is permitted to perform printing; and when receiving the permission information, control the print engine to perform printing using the cartridge removed from the permission-giving image recording apparatus.

12. The image recording apparatus according to claim 11, wherein the controller is further configured to:

set an operation mode to a first mode, when having not obtained specific information from the cartridge memory via the cartridge interface;

set the operation mode to a second mode, when having obtained the specific information from the cartridge memory via the cartridge interface; and receive the permission information from the permission-giving image recording apparatus via the communication interface, when the operation mode is set to the first mode.

13. The image recording apparatus according to claim 11, further comprising a display panel, wherein the controller is further configured to:

when receiving the permission information, control the display panel to display a permission screen, the permission screen representing that the image recording apparatus has been given the permission for printing; and when not receiving the permission information, control the display panel to display a non-permission screen, the non-permission screen representing that the image recording apparatus has not been given the permission for printing.

14. The image recording apparatus according to claim 11, wherein the controller is further configured to:

after completion of the printing performed based on the received permission information, generate print information regarding the printing; and transmit the generated print information to the permission-giving image recording apparatus via the communication interface.

15. The image recording apparatus according to claim 11, wherein the controller is further configured to:

obtain print data;

determine an expected number of sheets to be printed based on the obtained print data;

transmit inquiry information to the permission-giving image recording apparatus via the communication interface, the inquiry information including the determined expected number of sheets to be printed; and receive permitted printing information from the permission-giving image recording apparatus via the communication interface, the permitted printing information representing that the image recording apparatus has been given permission for printing for the expected number of sheets to be printed; and when receiving the permitted printing information, control the print engine to perform the printing.

16. An image recording apparatus comprising:

an attachment case configured to receive a cartridge removably attached thereto, the cartridge having a cartridge memory;

a print engine configured to perform printing on a sheet;

a cartridge interface;

a communication interface; and a controller having a memory, the controller being configured to:

set an operation mode to a first mode, when having not obtained specific information from the cartridge memory via the cartridge interface;

set the operation mode to a second mode, when having obtained the specific information from the cartridge memory via the cartridge interface;

when the operation mode is set to the second mode, perform:

storing apparatus identification information stored in the memory, into the cartridge memory via the cartridge interface, the apparatus identification information identifying the image recording apparatus; and receiving first permission application information from another image recording apparatus via the communication interface, the permission application information including reception identification information for identifying the another image recording apparatus;

determining whether or not the reception identification information included in the received first permission application information is identical to the apparatus identification information stored in the memory; and transmitting first permission information to the another image recording apparatus via the communication interface, when determining that the cartridge has been removed from the attachment case and determining that the reception identification information is identical to the apparatus identification information, the first permission information representing that the another image recording apparatus is permitted to perform printing using the cartridge removed from the image recording apparatus; and when the operation mode is set to the first mode, perform:

determining whether or not the controller has obtained the apparatus identification information from the cartridge memory via the cartridge interface;

when determining that the controller has obtained the apparatus identification information, transmitting second permission application information including the apparatus identification information, to a permission-giving image recording apparatus via the communication interface;

receiving second permission information from the permission-giving image recording apparatus via the communication interface, the second permission information representing that the image recording apparatus is permitted to perform printing; and when receiving the second permission information, controlling the print engine to perform printing.

17. A non-transitory computer-readable medium storing computer-readable instructions executable by a processor of an image recording apparatus comprising:

an attachment case configured to receive a cartridge removably attached thereto, the cartridge having a cartridge memory;

a print engine configured to perform printing on a sheet;

a cartridge interface;

a communication interface; and a memory, the instructions being configured to, when executed by the processor, cause the processor to:

store apparatus identification information stored in the memory, into the cartridge memory via the cartridge interface, the apparatus identification information identifying the image recording apparatus; and receive permission application information from another image recording apparatus via the communication interface, the permission application information including reception identification information for identifying the another image recording apparatus;

determine whether or not the reception identification information included in the received permission application information is identical to the apparatus identification information stored in the memory or the cartridge identification information stored in the memory; and transmit permission information to the another image recording apparatus via the communication interface, when determining that the cartridge has been removed from the attachment case and determining that the reception identification information is identical to the apparatus identification information or the cartridge identification information, the permission information representing that the another image recording apparatus is permitted to perform printing using the cartridge removed from the image recording apparatus.

18. A non-transitory computer-readable medium storing computer-readable instructions executable by a processor of an image recording apparatus comprising:

an attachment case configured to receive a cartridge removably attached thereto, the cartridge having a cartridge memory;

a print engine configured to perform printing on a sheet;

a cartridge interface;

a communication interface; and a memory, the instructions being configured to, when executed by the processor, cause the processor to:

determine whether or not the processor has obtained, from the cartridge memory of the cartridge attached to the attachment case via the cartridge interface, apparatus identification information representing a permission-giving image recording apparatus, the apparatus identification information identifying the permission-giving image recording apparatus;

when determining that the processor has obtained the apparatus identification information, transmit permission application information including the apparatus identification information to the permission-giving image recording apparatus via the communication interface, the permission application information including reception identification information for identifying the image recording apparatus;

receive permission information from the permission-giving image recording apparatus via the communication interface, the permission information representing that the image recording apparatus is permitted to perform printing; and when receiving the permission information, control the print engine to perform printing using the cartridge removed from the permission-giving image recording apparatus.

19. A non-transitory computer-readable medium storing computer-readable instructions executable by a processor of an image recording apparatus comprising:

an attachment case configured to receive a cartridge removably attached thereto, the cartridge having a cartridge memory;

a print engine configured to perform printing on a sheet;

a cartridge interface;

a communication interface; and a memory, the instructions being configured to, when executed by the processor, cause the processor to:

set an operation mode to a first mode, when having not obtained specific information from the cartridge memory via the cartridge interface;

set the operation mode to a second mode, when having obtained the specific information from the cartridge memory via the cartridge interface;

when the operation mode is set to the second mode, perform:

storing apparatus identification information stored in the memory, into the cartridge memory via the cartridge interface, the apparatus identification information identifying the image recording apparatus; and receiving first permission application information from another image recording apparatus via the communication interface, the first permission application information including reception identification information for identifying the another image recording apparatus;

determining whether or not reception identification information included in the received first permission application information is identical to the apparatus identification information stored in the memory or the cartridge identification information stored in the memory; and transmitting first permission information to the another image recording apparatus via the communication interface, when determining that the cartridge has been removed from the attachment case and determining that the reception identification information is identical to the apparatus identification information or the cartridge identification information, the first permission information representing that the another image recording apparatus is permitted to perform printing using the cartridge removed from the image recording apparatus;

when the operation mode is set to the first mode, perform:

determining whether or not the processor has obtained the apparatus identification information from the cartridge memory via the cartridge interface;

when determining that the processor has obtained the apparatus identification information, transmitting second permission application information including the apparatus identification information, to a permission-giving image recording apparatus via the communication interface;

receiving second permission information from the permission-giving image recording apparatus via the communication interface, the second permission information representing that the image recording apparatus is permitted to perform printing; and when receiving the second permission information, controlling the print engine to perform printing.

* * * * *